US007016841B2

(12) United States Patent
Kenmochi et al.

(10) Patent No.: US 7,016,841 B2
(45) Date of Patent: Mar. 21, 2006

(54) SINGING VOICE SYNTHESIZING APPARATUS, SINGING VOICE SYNTHESIZING METHOD, AND PROGRAM FOR REALIZING SINGING VOICE SYNTHESIZING METHOD

(75) Inventors: Hideki Kenmochi, Shimizu (JP); Xavier Serra, Barcelona (ES); Jordi Bonada, Barcelona (ES)

(73) Assignee: Yamaha Corporation, Hamamatsu (JP)

( * ) Notice: Subject to any disclaimer, the term of this patent is extended or adjusted under 35 U.S.C. 154(b) by 562 days.

(21) Appl. No.: 10/034,359

(22) Filed: Dec. 27, 2001

(65) Prior Publication Data

US 2003/0009336 A1 Jan. 9, 2003

(30) Foreign Application Priority Data

Dec. 28, 2000 (JP) ..... 2000-401041

(51) Int. Cl.
*G10L 13/00* (2006.01)
*G10H 7/00* (2006.01)

(52) U.S. Cl. ..... 704/258; 704/266; 84/604

(58) Field of Classification Search ..... 704/201, 704/203, 205, 206, 207, 211, 221, 258, 266, 704/267, 268, 269; 84/604, 609, 622, 623, 84/624, 627

See application file for complete search history.

(56) References Cited

U.S. PATENT DOCUMENTS 5,029,509 A 7/1991 Serra et al.
5,536,902 A 7/1996 Serra et al.
5,698,807 A * 12/1997 Massie et al. ..... 84/661
5,750,912 A * 5/1998 Matsumoto ..... 84/609
5,857,171 A * 1/1999 Kageyama et al. ..... 704/268
5,895,449 A * 4/1999 Nakajima et al. ..... 704/278
5,998,725 A * 12/1999 Ohta ..... 84/627
6,304,846 B1 * 10/2001 George et al. ..... 704/270
6,462,264 B1 * 10/2002 Elam ..... 84/645
6,748,355 B1 * 6/2004 Miner et al. ..... 704/203

(Continued)

FOREIGN PATENT DOCUMENTS

JP S57-163299 10/1982

(Continued)

OTHER PUBLICATIONS

Koyama et al., Speech Synthesis By Rule Based on Waveform Synthesis Units, Technical Report (Speech) of the Institute of Electronics, Information and Communication Engineers, SP96-8, pp. 53-60, May 1996.

(Continued)

*Primary Examiner*—Martin Lerner
(74) *Attorney, Agent, or Firm*—Pillsbury Winthrop Shaw Pittman LLP

(57) ABSTRACT

A singing voice synthesizing apparatus is provided, which enables achievement of a natural sounding synthesized singing voice with a good level of comprehensibility. A phoneme database stores a plurality of voice fragment data formed of voice fragments each being a single phoneme or a phoneme chain of at least two concatenated phonemes, each of the plurality of voice fragment data comprising data of a deterministic component and data of a stochastic component. A readout device that reads out from the phoneme database the voice fragment data corresponding to inputted lyrics. A duration time adjusting device adjusts time duration of the read-out voice fragment data so as to match a desired tempo and manner of singing. An adjusting device adjusts the deterministic component and the stochastic component of the read-out voice fragment so as to match a desired pitch. A synthesizing device synthesizes a singing sound by sequentially concatenating the voice fragment data that have been adjusted by the duration time adjusting device and the adjusting device.

25 Claims, 21 Drawing Sheets

U.S. PATENT DOCUMENTS

| | | | | |
|---|---|---|---|---|
| 6,836,761 | B1 * | 12/2004 | Kawashima et al. | 704/258 |
| 2002/0184032 | A1 * | 12/2002 | Hisaminato et al. | 704/268 |
| 2003/0159568 | A1 * | 8/2003 | Kemmochi et al. | 84/626 |
| 2003/0221542 | A1 * | 12/2003 | Kenmochi et al. | 84/616 |
| 2004/0006472 | A1 * | 1/2004 | Kemmochi | 704/269 |
| 2004/0243413 | A1 * | 12/2004 | Kobayashi | 704/258 |
| 2005/0049875 | A1 * | 3/2005 | Kawashima et al. | 704/266 |

FOREIGN PATENT DOCUMENTS

| | | | |
|---|---|---|---|
| JP | 62-006299 | | 1/1987 |
| JP | A-63-25700 | | 2/1988 |
| JP | 3185500 | | 8/1991 |
| JP | 07325583 | A | 12/1995 |
| JP | H10-091191 | | 4/1998 |
| JP | 10124082 | A | 5/1998 |
| JP | 2906970 | | 4/1999 |
| JP | 11184490 | A | 7/1999 |
| JP | 2000-507377 | | 6/2000 |
| WO | WO97/36288 | | 10/1997 |

OTHER PUBLICATIONS

Japanese Office Action dated Feb. 17, 2004.

Hirokawa, Speech Units and Speech Synthesis Methods in Rule-based Speech Synthesis-Seeking higher quality-, Journal of the Acoustical Society of Japan, (1993), vol. 49, No. 12.

Japanese Office Action dated Aug. 17, 2004.

* cited by examiner

ORIGINAL RESIDUAL WAVEFORM

SYNTHESIS IN CASE WHERE FRAMES ARE READ OUT IN REVERSE DIRECTION WITH PHASE UNCHANGED

SYNTHESIS IN CASE WHERE FRAMES ARE READ OUT IN REVERSE DIRECTION WITH PHASE REVERSED

SINGING VOICE SYNTHESIZING APPARATUS, SINGING VOICE SYNTHESIZING METHOD, AND PROGRAM FOR REALIZING SINGING VOICE SYNTHESIZING METHOD

BACKGROUND OF THE INVENTION

1. Field of the Invention

The present invention relates to a singing voice synthesizing apparatus that synthesizes a singing voice, a method of synthesizing a singing voice, and a program for realizing the method thereof.

2. Description of the Related Art

In the past, there has been a wide range of attempts to synthesize singing voice.

One of these attempts, an application of speech synthesis by rule, receives inputs of pitch data, which corresponds to the pitch of a note, and of lyric data, and synthesizes speech using a synthesis-by-rule device for text-to-speech synthesis. In most cases, raw waveform data or analyzed and parameterized data are stored in a database in units of phonemes or phoneme chains comprised of two or more phonemes. At the time of synthesis, required voice fragments (phonemes or phoneme chains) are selected, concatenated, and synthesized. Examples are disclosed in Japanese Laid-Open Patent Publications (Kokai) Nos. S62-6299, H10-124082, and H11-1184490, among others.

However, since the object of these technologies is to synthesize a speaking voice, they are not always capable of synthesizing a singing voice with satisfactory quality.

For example, a singing voice synthesized by a method of overlapping and adding waveforms as typified by PSOLA (Pitch-Synchronous OverLap and Add) has a good degree of comprehensibility, but often has the problems of unnatural sounding of elongated tones, for which the quality of a singing voice varies the greatest, and an unnatural sounding synthesized voice when there are slight fluctuations of pitch and vibrato, which are essential for a singing voice.

Moreover, attempting to synthesize a singing voice using a waveform concatenating type speech synthesizing device with a large-scale corpus base would require an astronomically large number of fragment data if the original data are to be concatenated and output without any processing.

On the other hand, synthesizers whose original purpose is for synthesizing a singing voice have also been proposed. A well-known example is the synthesis method of formant synthesis (Japanese Laid-Open Patent Publication (Kokai) No. 3-200300). However, although this method offers a large degree of freedom with respect to the quality and fluctuations of vibrato and pitch of elongated sounds, the clarity of synthesized sounds (especially consonants) is poor, and therefore quality is not always satisfactory.

U.S. Pat. No. 5,029,509 discloses a technique known as Spectral Modeling Synthesis (SMS) for analyzing and synthesizing a musical sound using a model that expresses an original sound as comprised of two components, namely a deterministic component and a stochastic component.

With SMS analysis and synthesis, good control of the musical characteristics of a musical sound is possible, and at the same time, in the case of a singing voice, through use of the stochastic component, a high degree of clarity can be expected from even the consonants. Therefore, applying this technique to the synthesis of a singing voice is expected to achieve a synthesized sound having a high degree of clarity and musicality. In fact, Japanese Patent No. 2906970 proposes specific applications for sound synthesis based on SMS analysis and synthesis techniques, and at the same time, also describes a methodology for utilizing SMS techniques in singing voice synthesis (singing synthesizer).

An application of the techniques proposed in the aforementioned Japanese Patent No. 2906970 to a singing voice synthesizing apparatus will be described with reference to FIG. 17.

In FIG. 17, input voices are SMS-analyzed and segmented into individual voice fragments (phonemes or phoneme chains) by an SMS-analyzer/segmentor 103, which are stored to generate a phoneme database 100. The database 100, comprising voice fragment data (phoneme data 101 and phoneme chain data 102) for a single frame or plurality of frame strings arranged in a time series, stores SMS data for each frame, namely changes over time of the spectral envelope of the deterministic component, the spectral envelope and phase spectrum of the stochastic component, etc.

When synthesizing a singing voice sound, a phoneme string comprising the desired lyrics is obtained, a phoneme-to-fragment converter 104 determines the required voice fragments (phonemes or phoneme chains) that comprise the phoneme string, and then SMS data (deterministic component and stochastic component) of the required voice fragments is read from the aforementioned database 100. Next, a fragment concatenator 105 concatenates the read-out SMS data of the voice fragments into a time series. For the deterministic component, based on pitch information corresponding to a melody of the song, a deterministic component generator 106 generates harmonic components having the desired pitch while preserving the shape of the spectral envelope of the deterministic component. For example, to synthesize the Japanese word "saita", the fragments of "#s", "s", "s-a", "a", "a-i", "i", "i-t", "t", "t-a", "a", and "a#" are concatenated, and the deterministic component of the desired pitch is generated while preserving the shape of the spectral envelope included in the SMS data obtained from the fragment concatenation. Next, the generated deterministic component and the stochastic component are added together by a synthesizing means 107, and the result thereof is transformed into time domain data to obtain synthesized voice.

By thus utilizing these SMS techniques, natural sounding synthesized singing with good comprehensibility can be obtained even for elongated sounds.

However, the method described in the aforementioned Japanese Patent No. 2906970 is overly rudimentary and simplistic, and the following types of problems will occur if a singing voice is synthesized according to that method.

- Because the spectral envelope shape of the deterministic component of a voiced sound changes somewhat depending on pitch, synthesis at a pitch different from the pitch used at the time of analysis cannot, by itself, achieve good tone color.
- When performing SMS analysis in the case of a voiced sound, even if the deterministic component is removed, a small fraction of the deterministic component remains in the residual component. Therefore, using the same residual component (stochastic component) directly to synthesize a singing sound at a pitch different from the original sound as noted above causes the residual component to become audible noticeably or like noise.
- Because the SMS analysis results of phoneme data and phoneme chain data are superposed temporally as they are, the duration of an elongated sound and transitional time between phonemes cannot be adjusted. In other words, it is not possible to sing at a desired tempo.

Noise is apt to be generated when concatenating the phonemes or phoneme chains.

SUMMARY OF THE INVENTION

It is a first object of the present invention to provide a singing voice synthesizing apparatus and a singing voice synthesizing method that resolve the above described problems through prescribing a specific method for utilizing the SMS techniques proposed in the aforementioned Japanese Patent No. 2906970 and adding considerable improvements for enhancing the synthesized sound quality, to thereby enable achievement of a natural sounding synthesized singing voice with a good level of comprehensibility, and a program for realizing a singing voice synthesizing method.

It is a second object of the present invention to provide a singing voice synthesizing apparatus and a singing voice synthesizing method that are capable of reducing the size of the aforementioned database and increasing the efficiency with which the database is generated, and a program for realizing a singing voice synthesizing method.

It is a third object of the present invention to provide a singing voice synthesizing apparatus and a singing voice synthesizing method that are capable of adjusting the degree of huskiness in a synthesized voice, and a program for realizing a singing voice synthesizing method.

To attain the objects, the present invention provides a singing voice synthesizing apparatus comprising a phoneme database that stores a plurality of voice fragment data formed of voice fragments each being a single phoneme or a phoneme chain of at least two concatenated phonemes, each of the plurality of voice fragment data comprising data of a deterministic component and data of a stochastic component, an input device that inputs lyrics, a readout device that reads out from the phoneme database the voice fragment data corresponding to the inputted lyrics, a duration time adjusting device that adjusts time duration of the read-out voice fragment data so as to match a desired tempo and manner of singing, an adjusting device that adjusts the deterministic component and the stochastic component of the read-out voice fragment so as to match a desired pitch, and a synthesizing device that synthesizes a singing sound by sequentially concatenating the voice fragment data that have been adjusted by the duration time adjusting device and the adjusting device.

With the above arrangement according to the present invention, through improvement of the SMS techniques, a natural sounding synthesized singing voice with a good level of comprehensibility can be obtained even for elongated sounds, and further, even slight variations of vibrato and pitch do not result in an unnatural sounding synthesized sound.

Preferably, the phoneme database stores a plurality of voice fragment data having different musical expressions for a single phoneme or phoneme chain.

More preferably, the musical expressions include at least one parameter selected from the group consisting of pitch, dynamics and tempo.

In a preferred embodiment of the present invention, the phoneme database stores voice fragment data comprising elongated sounds that are each enunciated by elongating a single phoneme, voice fragment data comprising consonant-to-vowel phoneme chains and vowel-to-consonant phoneme chains, voice fragment data comprising consonant-to-consonant phoneme chains, and voice fragment data comprising vowel-to-vowel phoneme chains.

In a preferred form of the present invention, each of the voice fragment data comprises a plurality of data corresponding respectively to a plurality of frames of a frame string formed by segmenting a corresponding one of the voice fragments, and wherein the data of the deterministic component and the data of the stochastic component of each of the voice fragment data each comprise a series of frequency domain data corresponding respectively to the plurality of frames of the frame string corresponding to each of the voice fragments.

Moreover, in this preferred form, the duration time adjusting device generates a frame string of a desired time length by repeating at least one frame of the plurality of frames of the frame string corresponding to each of the voice fragments, or by thinning out a predetermined number of frames of the plurality of frames of the frame string corresponding to each of the voice fragments.

With this arrangement, since the length of an elongated phoneme and length of a phoneme chain can be adjusted freely, a synthesized singing voice can be obtained at a desired tempo.

More preferably, the duration time adjusting device generates the frame string of a desired time length by repeating a plurality of frames of the frame string corresponding to each of the voice fragments, the duration time adjusting device repeating the plurality of frames in a first direction in which the frame string of a desired time length is generated and in a second direction opposite thereto.

Still more preferably, when repeating the plurality of frames of the frame string corresponding to the data of the stochastic component of each of the voice fragments in the first and second directions, the duration time adjusting device reverses a phase of a phase spectrum of the stochastic component.

Preferably, the singing voice synthesizing apparatus according to the present invention further comprises a fragment level adjusting device that performs smoothing processing or level adjusting processing on the deterministic component and the stochastic component contained in each of the voice fragment data when the voice fragment data are sequentially concatenated by the synthesizing device.

With this arrangement, since a smoothing or level adjusting process is performed at the concatenation boundary between phonemes, noise is not generated when the phonemes are concatenated.

Also preferably, the singing voice synthesizing apparatus according to the present invention further comprises a deterministic component generating device that changes only pitch of the deterministic component to a desired pitch while preserving the spectral envelope shape of the deterministic component contained in each of the voice fragment data when the voice fragment data are sequentially concatenated by the synthesizing device.

Preferably, the phoneme database stores voice fragment data comprising elongated sounds that are each enunciated by elongating a single phoneme, the phoneme database further storing a flat spectrum as an amplitude spectrum of the stochastic component of each of the voice fragment data comprising each of the elongated sounds, obtained by multiplying the amplitude spectrum thereof by an inverse of a typical spectrum within an interval of the elongated sound.

In this case, the amplitude spectrum of the stochastic component of each of the voice fragment data comprising each of the elongated sounds is obtained by multiplying an amplitude spectrum of the stochastic component calculated based on an amplitude spectrum of the deterministic component of the voice fragment data of the elongated sound, by the flat spectrum.

Preferably, the phoneme database does not store amplitude spectra of stochastic components of voice fragment data comprising certain elongated sounds, and the flat spectrum stored as an amplitude spectrum of voice fragment data comprising at least one other elongated sound is used for synthesis of the certain sounds.

Preferably, the amplitude spectrum of the stochastic component calculated based on the amplitude spectrum of the deterministic component has a gain thereof at 0 Hz controlled according to a parameter for controlling a degree of huskiness.

With this arrangement, the degree of huskiness of a synthesized voice can be controlled simply.

To attain the above objects, the present invention also provides a singing voice synthesizing method comprising the steps of storing in a phoneme database a plurality of voice fragment data formed of voice fragments each being a single phoneme or a phoneme chain of at least two concatenated phonemes, each of the plurality of voice fragment data comprising data of a deterministic component and data of a stochastic component, reading out from the phoneme database the voice fragment data corresponding to lyrics inputted by an input device, adjusting time duration of the read-out voice fragment data so as to match a desired tempo and manner of singing, adjusting the deterministic component and the stochastic component of the read-out voice fragment so as to match a desired pitch, and synthesizing a singing sound by sequentially concatenating the voice fragment data that have been adjusted in respect of the time duration and the deterministic component and the stochastic component thereof.

To attain the above objects, the present invention further provides a program for causing a computer to execute the above mentioned singing voice synthesizing method.

To attain the above objects, the present invention further provides a mechanically readable storage medium storing instructions for causing a machine to execute the above mentioned singing voice synthesizing method.

According to the present invention, the synthesized singing voice can be of high quality, having an appropriate tone color for a desired pitch, and is free of noise between concatenated units. Further, the database can be made extremely small in size and can be generated with a higher efficiency. Still further, the degree of huskiness of a synthesized voice can be controlled simply.

The above and other objects, features, and advantages of the invention will become more apparent from the following detailed description taken in conjunction with the accompanying drawings.

BRIEF DESCRIPTION OF THE DRAWINGS

FIGS. 3A and 3B are diagrams illustrating a process for adjusting a stochastic component carried out by the singing voice synthesizing apparatus of the present invention, in which:

FIG. 3A shows an example of amplitude spectrum of a stochastic component obtained by SMS analysis of a voiced sound; and FIG. 3B shows the result of performing a stochastic component adjusting process on the amplitude spectrum of the stochastic component of FIG. 3A;

FIGS. 4A to 4C are diagrams illustrating a looping process carried out by the singing voice synthesizing apparatus of the present invention, in which:

FIG. 4A shows an example of a stochastic component waveform that will be subjected to loop processing;

FIG. 4B shows the result of loop processing the waveform of FIG. 4A, where frames are read-out in a reverse direction, with the phase unchanged; and FIG. 4C shows the result of loop processing the waveform of FIG. 4A, where frames are read-out in a reverse direction, with the phase reversed;

FIGS. 8A through 8C are diagrams illustrating a level adjusting process carried out by the singing voice synthesizing apparatus of the present invention, in which:

FIG. 8A is a diagram illustrating a level adjusting process for fragment "a-i" at the time when the fragments of "a-i" and "i-a" are to be concatenated;

FIG. 8B is a diagram illustrating a level adjusting process for fragment "i-a"; and FIG. 8C is a diagram showing a result of concatenating the level adjusted fragments of "a-i" and "i-a";

DETAILED DESCRIPTION OF THE PREFERRED EMBODIMENTS

The singing voice synthesizing apparatus of the present invention has a phoneme database which is comprised of individual phonemes and phoneme chains that have been obtained by dividing into required segments SMS data of deterministic and stochastic components obtained from an SMS analysis of input voices. This database also contains heading information including information indicative of the phonemes and phoneme chains, information indicative of the pitch of voice fragments formed of the phonemes and phoneme chains, and information indicative of musical expressions such as dynamics and tempo thereof. Here, the dynamics information may be either sensory information indicative of whether the voice fragment (phoneme or phoneme chain) is a forte or mezzo forte sound, or physical information indicating the level of the fragment.

Moreover, an SMS analysis means is provided for decomposing the input singing voice into deterministic and stochastic components, and analyzing them in order to generate the aforementioned database. Also, a means (which may be either automatic or manual) for segmenting the SMS data into the required phonemes or phoneme chains (fragments) is provided.

An example of generating the phoneme database will be described with reference to FIG. 1.

Figure 1:
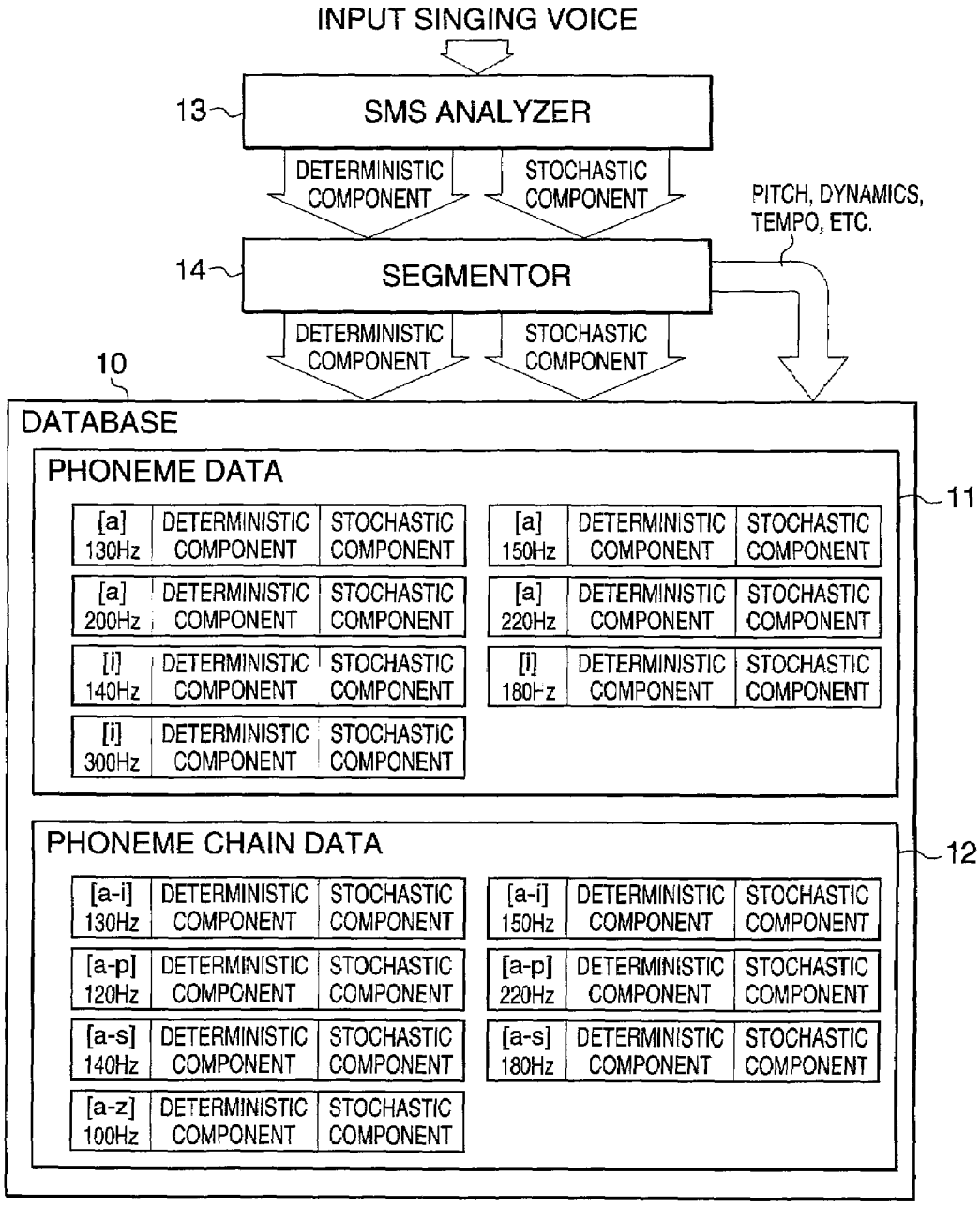
FIG. 1 is a diagram illustrating a process for generating a phoneme database used in a singing voice synthesizing apparatus of the present invention.

In FIG. 1, reference numeral 10 designates the phoneme database in which are stored SMS data in the form of voice fragments (SMS data of one or more frames determined by the respective voice fragments) obtained by subjecting input singing voices to an SMS analysis and segmenting the resulting SMS data into phonemes and phoneme chains (voice fragments) by a segmentor 14 in a manner similar to the aforementioned phoneme database 100. In the phoneme database 10, the fragment data are stored in the form of separate data for each different pitch, and for each different dynamics and tempo.

In the case of synthesizing Japanese language lyrics, the voice fragments are comprised of, for example, vowel sound data (one or a plurality of frames), consonant-to-vowel sound data (a plurality of frames), vowel-to-consonant sound data (a plurality of frames), and vowel-to-vowel data (a plurality of frames).

A voice synthesis apparatus that uses voice synthesis by rule or the like normally stores data in its phoneme database in units that are longer than one syllable, such as VCV (vowel-consonant-vowel) or CVC (consonant-vowel-consonant) units. On the other hand, in the singing voice synthesizing apparatus of the present invention which aims to synthesize a singing voice sound, data of elongated sound, which frequently occurs in singing as the enunciation of long vowels, consonant-to-vowel (CV), vowel-to-consonant (VC) sound data, consonant-to-consonant sound data, and vowel-to-vowel sound data are stored in the phoneme database.

The SMS analyzer 13 performs an SMS analysis of original input singing voices and outputs SMS-analyzed data for each frame.

More specifically, the input voice is divided into a series of time frames, and an FFT or other frequency analysis is performed for each frame. From the resulting frequency spectra (complex spectra), amplitude spectra and phase spectra are obtained, and a specific frequency spectrum that corresponds to a peak in the amplitude spectrum is extracted as a line spectrum. In this case, a spectrum containing the fundamental frequency and frequencies in the vicinity of its integer multiples is a line spectrum. This extracted line spectrum corresponds to the deterministic component.

Next, a residual spectrum is obtained by subtracting the line spectrum, which has been extracted as described above, from the spectrum of the input waveform of the frame. Alternatively, temporal waveform data of the deterministic component, which has been synthesized from the extracted line spectrum, is subtracted from the input waveform data of that frame to obtain temporal waveform data of the residual component, and then a frequency analysis of the residual component temporal waveform data is performed to obtain the residual spectrum. The thus-obtained residual spectrum corresponds to the stochastic component.

The frame period used in the above SMS analysis may have either a certain fixed length, or a variable length that changes according to the pitch or other parameter of the input voice. If the frame period has a variable length, the input voice is processed with a first frame period of fixed length, the pitch is detected, and then the input voice is reprocessed with a frame period of a length that corresponds to the results of the pitch detection; alternatively, a method may be employed, in which the period of the following frame is varied according to the pitch detected from the present frame.

The SMS-analyzed data output for each frame from the SMS analyzer 13 is segmented into the length of a voice fragment stored in the phoneme database by the segmentor 14. More specifically, the SMS-analyzed data is manually or automatically segmented to extract vowel phonemes, vowel-consonant or consonant-vowel phoneme chains, consonant-consonant phoneme chains, and vowel-vowel phoneme chains so as to be optimally suited for singing sound synthesis. Here, long interval data of vowels that are to be elongated and sung (elongated sounds) are also extracted by segmentation as vowel phonemes.

Moreover, the segmentor 14 detects the pitch of the input voice based on the aforementioned SMS analysis results. The pitch detection is performed by first calculating an average pitch value from the frequency of lower-order line spectra in the deterministic component of a frame included in the fragment, and then calculating an average pitch value for all frames.

In this manner, data of the deterministic component and data of the stochastic component are extracted for each fragment and stored in the phoneme database 10, with headings comprised of information of the pitch of the input singing voice and musical expressions of tempo, dynamics, etc. appended thereto.

FIG. 1 shows one example of the phoneme database 10 that has been created in this manner. The phoneme database 10 is comprised of a phoneme data area 11 for phonemes, and a phoneme chain data area 12 for phoneme chains. The phoneme data area 11 contains four types of phoneme data of elongated vowel "a" at four pitch frequencies of 130 Hz, 150 Hz, 200 Hz and 220 Hz, and three types of phoneme data of elongated vowel "i" at three pitch frequencies 140 Hz, 180 Hz and 300 Hz. Moreover, the phoneme chain data area 12 contains two types of phoneme chain data of phoneme chain "a-i", indicating the concatenation of phonemes "a" and "i", at two pitch frequencies of 130 Hz and 150 Hz, two types of phoneme chain "a-p" at two frequencies of 120 Hz and 220 Hz, two types of phoneme chain "a-s" at frequencies of 140 Hz and 180 Hz, and one type of phoneme chain "a-z" at a frequency of 100 Hz. Here, for the same phoneme or phoneme chain, data of different pitches are stored; however as described above, data of different musical expressions of the input singing voice, such as dynamics and tempo, are also stored as separate data.

Of data of deterministic and stochastic components contained in the data of each fragment, namely, SMS data SMS from the aforementioned SMS analyzer 13 that has been segmented into individual fragments by the segmentor 14, the data of deterministic components may be stored either by storing all spectral envelopes (line spectra (harmonic series) strength (amplitude) and phase spectra) of each frame contained in each fragment as they are, or by storing arbitrary functions that express the spectral envelopes instead of spectral envelopes. The data of deterministic components may also be stored in the form of inverse-transformed temporal waveforms. Furthermore, the data of stochastic components may be stored in the form of strength spectra (amplitude spectra) and phase spectra for each frame of the segment corresponding to each fragment, or in the form of temporal waveform data of each segment. Moreover, the above-noted storage formats are not limitative, but may be varied for each fragment, or according to vocal properties (such as nasal, fricative or plosive sounds) of each segment. In the description that follows, the deterministic component data are stored in the format of spectral envelopes, and the stochastic component data are stored in the format of amplitude spectra and phase spectra. With these types of storage format, the required storage capacity can be reduced.

In this manner, in the singing voice synthesizing apparatus of the present invention, the phoneme database 10 stores a plurality of data corresponding to different pitches, dynamics, tempos, and other musical expressions for each of the same phoneme and the same phoneme chain.

Next, the process of synthesizing singing sounds using the phoneme database 10 created as described above will be described with reference to FIGS. 2A and 2B.

Figure 2A:
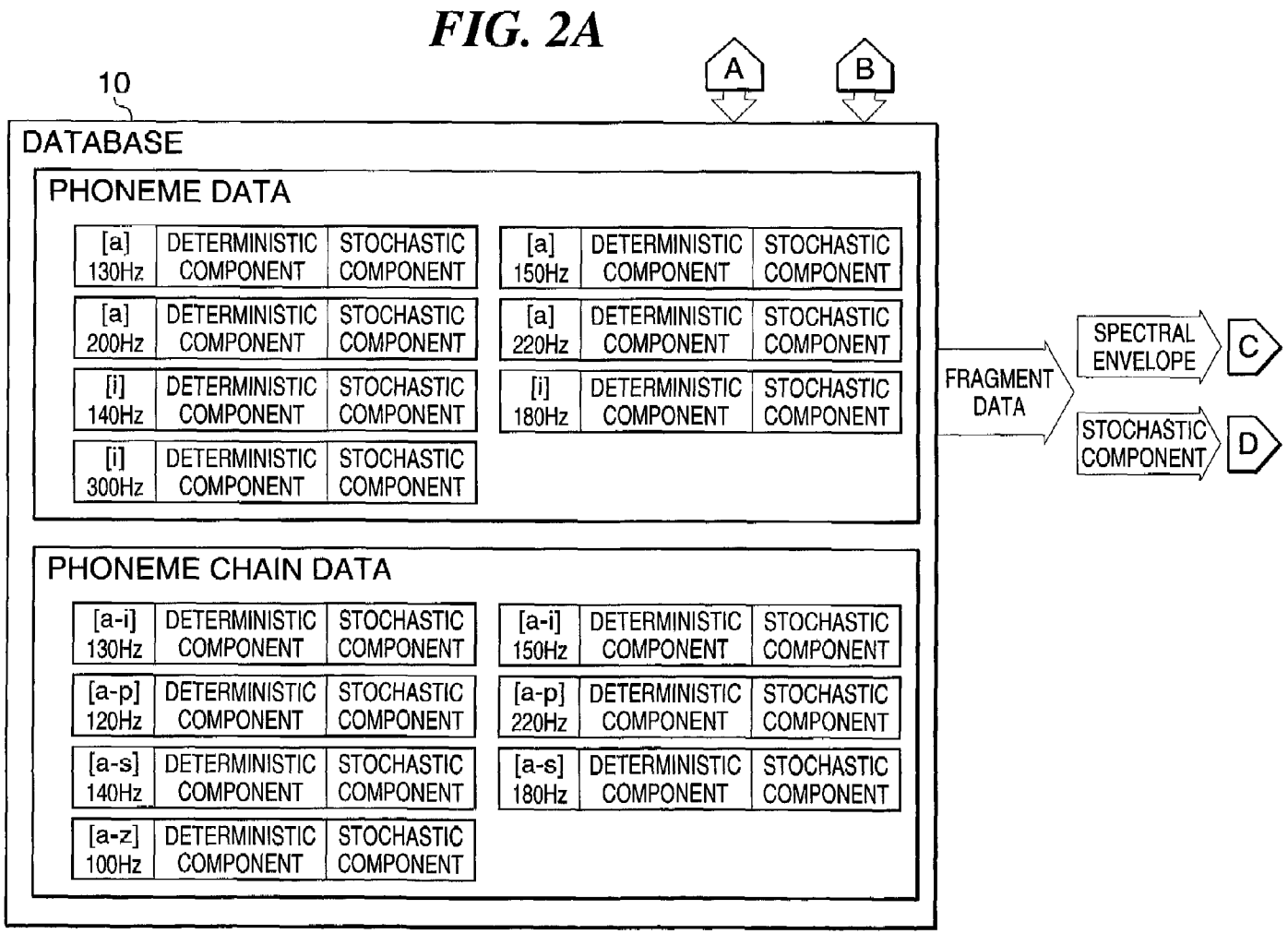
FIGS. 2A and 2B is a diagram illustrating a process for synthesizing a singing voice carried out by the singing voice synthesizing apparatus of the present invention.
Figure 2B:
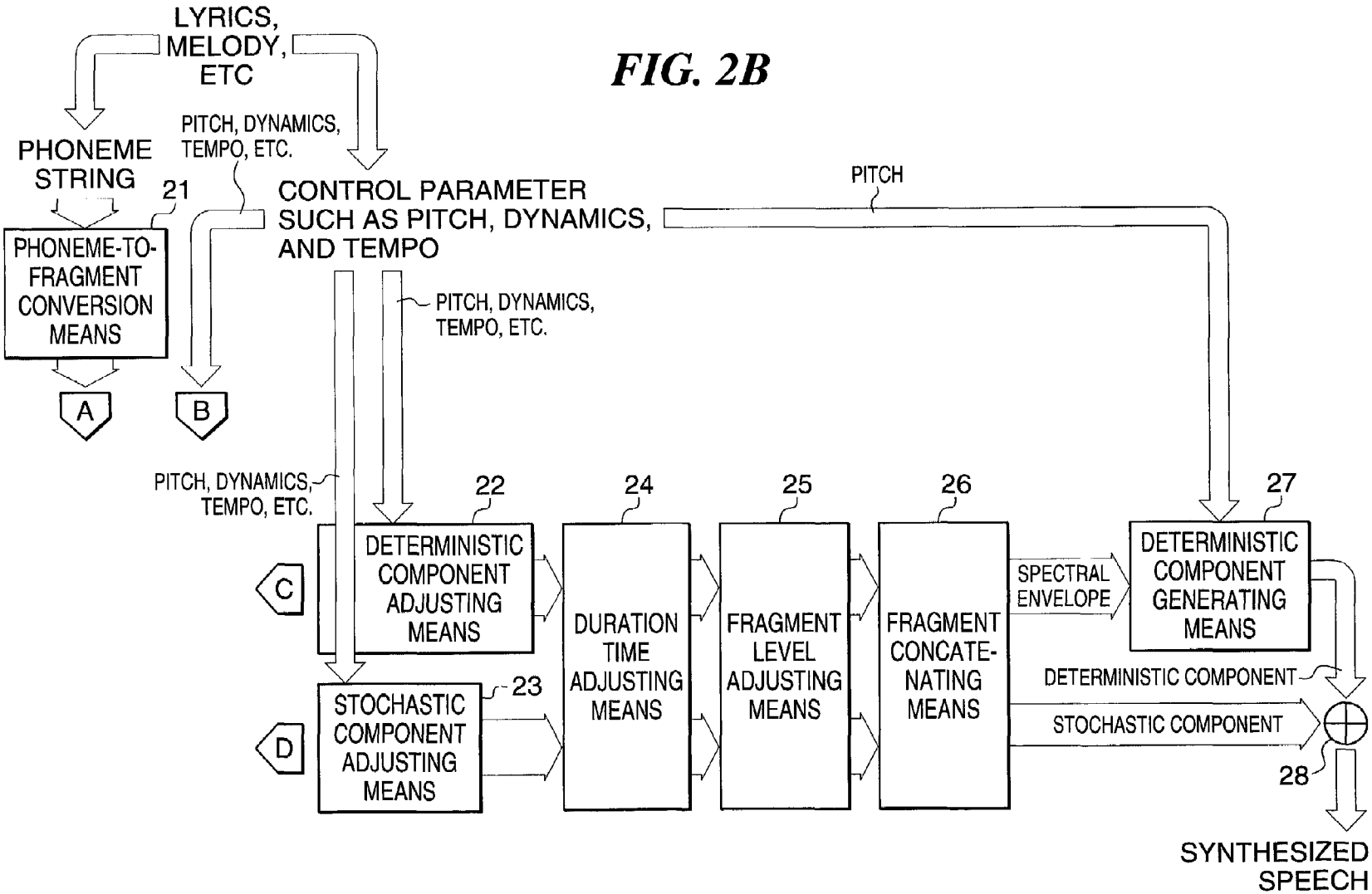

In FIGS. 2A and 2B, reference numeral 10 designates the phoneme database 10. Reference numeral 21 designates a phoneme-to-fragment conversion means 21 that converts a phoneme string corresponding to the lyric data of a song for which a singing sound is to be synthesized, into fragments for searching the phoneme database 10. For example, if a phoneme string of "s_a_i_t_a" is input, then a fragment string of "s", "s-a", "a", "a-i", "i", "i-t", "t", "t-a", and "a" is output.

Reference numeral 22 designates a deterministic component adjusting means that, based on control parameters such as pitch, dynamics and tempo that are included in the melody data of the song, adjusts the data of the deterministic component of fragment data read from the phoneme database 10, and reference numeral 23 designates a stochastic component adjusting means that adjusts the data of the stochastic component.

Reference numeral 24 designates a duration time adjusting means that varies the duration time of fragment data output from the deterministic component adjusting means 22 and from the stochastic component adjusting means 23. Reference numeral 25 designates a fragment level adjusting means that adjusts the level of each fragment data output from the duration time adjusting means 24. Reference numeral 26 designates a fragment concatenating means that concatenates individual fragment data, which have been level-adjusted by the fragment level adjusting means 25, into a time series. Reference numeral 27 designates a deterministic component generating means that, based on the deterministic components of fragment data that have been concatenated by the fragment concatenating means 26, generates deterministic components (harmonic components) having a desired pitch. Reference numeral 28 designates an adding means that synthesizes harmonic components generated by the deterministic component generating means 27 and stochastic components output from the fragment concatenating means 26. Voice synthesis can be achieved by transforming the output from this adding means 28 into a time domain signal.

The processing of each of the above-mentioned blocks will be described below.

The phoneme-to-fragment conversion means 21 generates a fragment string from a phoneme string that has been converted based on the input lyrics, and thereupon selectively reads out voice fragments (phonemes or phoneme chains) from the phoneme database 10. As described previously, even for a single phoneme or phoneme chain, a plurality of data (voice fragment data) are stored in the database corresponding respectively to the pitch, dynamics, tempo, etc. When selecting a fragment, the most suitable one is chosen according to the various control parameters.

Moreover, instead of selecting a fragment, it may be so arranged that several candidates are selected for interpolation to obtain SMS data to be used for synthesis. The selected voice fragments contain deterministic components and stochastic components which are results of the SMS analysis. These deterministic and stochastic components contain SMS data, namely, the spectral envelopes (strength and phase) of the deterministic components, the spectral envelopes (strength and phase) of the stochastic component, and waveforms themselves. Based on these contents, deterministic components and stochastic components are generated so as to match a desired pitch and required duration time. For example, the shapes of spectral envelopes of deterministic and stochastic components are obtained by interpolation or other means and may be varied so as to match the desired pitch.

Adjustment of Deterministic Component

Adjustment of the deterministic component is performed by the deterministic component adjusting means 22.

In the case of a voiced sound, the deterministic component contains strength and phase spectral envelope information, which are the SMS analysis results. In the case of a plurality of fragments, either the fragment most ideally suited for the desired control parameter (such as pitch) is selected, or a spectral envelope suitable for the desired control parameter is obtained by performing an operation such as interpolating the plurality of fragments. In addition, the shape of the obtained spectral envelope may be further changed according to another control parameter by a suitable method.

Moreover, to decrease harsh noises, or to give the sound a special characteristic, band pass filtering may be applied to allow components of a certain frequency band to pass.

An unvoiced sound contains no deterministic component.

Adjustment of Stochastic Component

Since the stochastic component from the SMS analysis of a voiced sound remains influenced by its original pitch, an attempt to match the sound to another pitch may result in an unnatural sound. To prevent this, processing needs to be carried out on low frequency stochastic components to achieve matching with the desired pitch. This processing is performed by the stochastic component adjusting means 23.

The processing of adjustment of the stochastic component will be described with reference to FIGS. 3A and 3B.

Figures 3A, 3B:
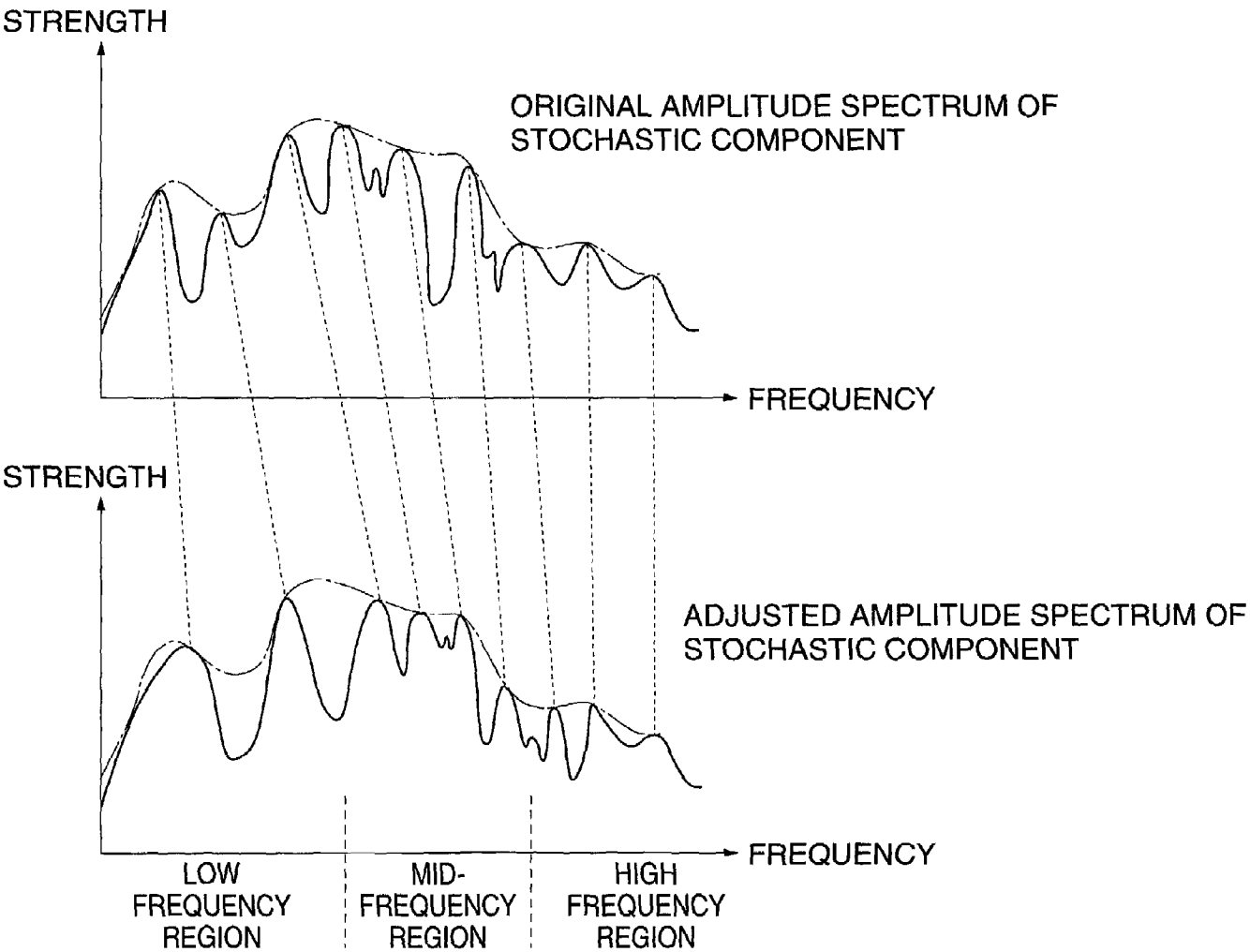

FIG. 3A is an example of an amplitude spectrum of a stochastic component obtained from an SMS analysis of a voiced sound. It is difficult to completely remove the effect of the deterministic component, and as shown in the figure, there are some peaks in the vicinity of the harmonics. If this stochastic component is used as it is, to synthesize a voice sound at a pitch different from the original pitch, peaks will appear in the vicinity of lower frequency harmonics, which do not blend smoothly with the deterministic component and audible as a harsh sound. To avoid this, the frequency of the stochastic component may be varied so as to match a change in pitch. However, since high frequency stochastic components are less affected by the deterministic component, it is desirable to use the original amplitude spectrum as it is. In other words, in the low frequency region, it should be sufficient to compress and expand the frequency axis according to the desired pitch. However, the original tone color must not be changed at this time. Namely, it is necessary that the general shape of the amplitude spectrum be preserved while carrying out this processing.

FIG. 3B shows the results of performing the above processing. As shown in the figure, three peaks in the low frequency region have been shifted rightward according to the pitch. The gaps between peaks in the mid-frequency region have been made narrower, and peaks in the high frequency region remain unchanged. The height of each peak is adjusted to preserve the general shape of the amplitude spectrum, indicated by a broken line in the figure.

In the case of an unvoiced sound, the above described processing is unnecessary as it is not affected by the original pitch.

The stochastic component thus obtained by the above processing may further be subjected to additional processing (such as changing the shape of the spectral envelope) according to a control parameter. Moreover, to decrease harsh noises, or to give the sound a special characteristic, band pass filtering may be applied to allow components of a certain frequency band to pass.

Adjustment of Duration Time

In the above described processing, the fragments are processed with their original length maintained, so that singing voice synthesis can only be carried out in fixed timing. Therefore, depending on the desired timing, it is necessary to change the duration of the fragment as required. For example, in the case of a phoneme chain, the fragment length can be made shorter by thinning out frames within the fragment, or made longer by adding duplicate frames within the fragment. Moreover, in the case of a single phoneme (the case of an elongated sound), the elongated part can be made shorter by using only some of the frames within the fragment, or made longer by repeating frames within the fragment.

When repeating within frames within a fragment of an elongated sound, it is known that noise at the junction between frames can be decreased by repeating in a manner of advancing in one direction, returning in the reverse direction, and then again advancing in the original direction (in other words, looping within a fixed interval or a random interval), rather than repeating in a single direction. However, in the case where the stochastic component has been segmented into frames (of either fixed or variable length) and stored as frequency domain data, there is a problem when attempting to synthesize a waveform by repeating frequency domain frame data in its original format. The reason is that, when proceeding in the reverse direction, the waveform in the frame must also be reversed with respect to time. To generate such a time-reversed waveform from frame data of the original frequency domain, the phase in the frequency domain may be reversed and transformed into the time domain. FIGS. 4 to 4C show this condition.

Figure 4A:
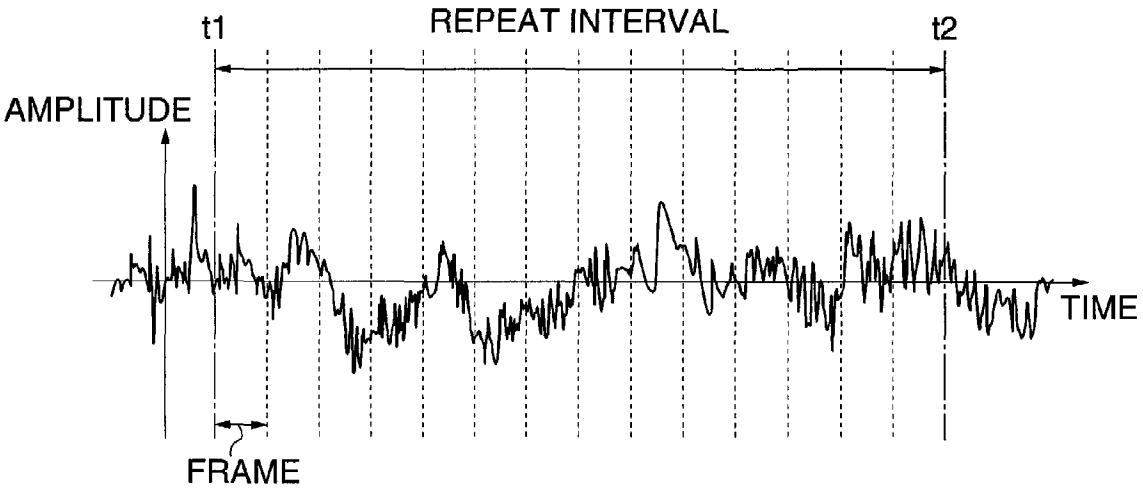
Figure 4B:
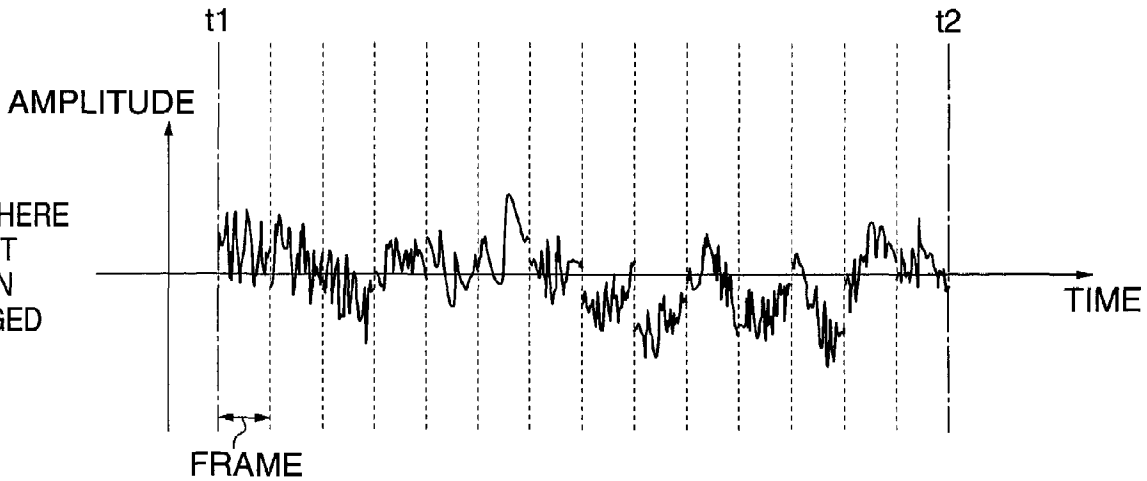
Figure 4C:
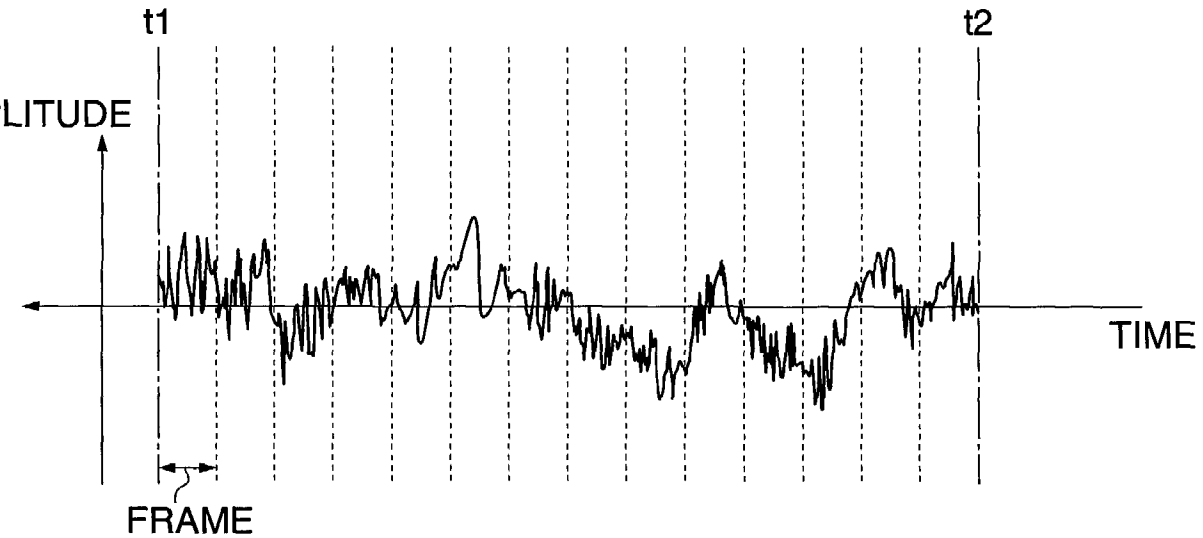

FIG. 4A shows an original waveform of a stochastic component. A stochastic component for an elongated sound is generated by repeating the interval between t1 and t2, by first advancing from t1 until t2, proceeding in the reverse time direction after reaching t2, and then upon reaching t1, proceeding in the forward time direction. As noted previously, the stochastic component has been segmented into frames of either fixed or variable length and stored as frequency domain data. To generate a waveform in the time domain, an inverse FFT is performed on the frequency domain frame data, and a window function and overlapping are applied for synthesis of the waveform. In the case where synthesis is performed by reading frames in the reverse time direction, if the frequency domain frame data is transformed as it is into the time domain, as shown in FIG. 4B, the waveform within each frame remains unchanged temporally and only the frame sequence is reversed. This creates discontinuities in the generated waveform that cause noise and distortion.

A solution to this problem with generation of a time domain waveform from frame data is to pre-process the frame data so that a time-reversed waveform will be generated.

If the original waveform is designated by f(t) (which, for the sake of simplicity, is assumed to be infinitely continuous) and a time-reversed waveform g(t), and respective Fourier transforms applied to these waveforms $F(\omega)$ and $G(\omega)$, $g(t)=f(-t)$ holds, and since f(t) and g(t) are both real functions, the following relation is established:

$G(\omega)=F(\omega)^*$ (where * indicates a complex conjugate)

When expressed with amplitude and phase, since the phase of the complex conjugate will be reversed, it will be learned that all phase spectra of the frequency domain frame data should be reversed in order to generate a time-reversed waveform. In this manner, as shown in FIG. 4C, the waveform even within each frame is reversed with respect to time, and noise and distortion are not generated.

The duration time adjusting means 24 performs the above described fragment compression (thinning out of frames), expansion (repeating of frames) and looping (in the case of elongated sounds). Through such processing, the duration (or in other words, the length of the frame string) of each read-out fragment can be adjusted to a desired length.

Adjustment of Fragment Level

Furthermore, noise may be audible if the disparity between spectral envelope shapes of the deterministic component and the stochastic component is too large at the concatenation boundary where one fragment is connected to another. Performing a smoothing process over a plurality of frames at their concatenation boundaries can eliminate this problem.

Figure 5:
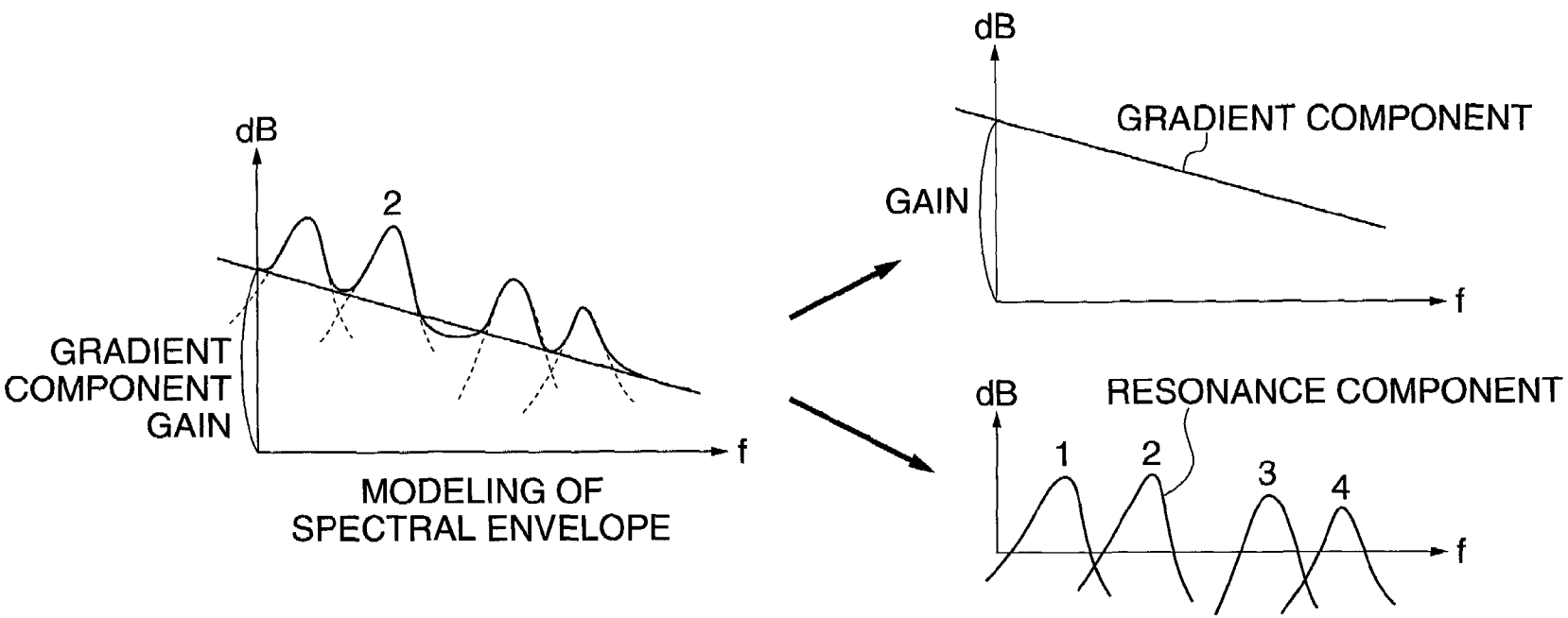
FIG. 5 is a diagram illustrating the modeling of a spectral envelope.

This smoothing process will be described with reference to FIGS. 5 through 7.

Since stochastic components are relatively difficult to hear even if there are differences in tone color and level at the fragment concatenation boundary, here, a smoothing process will be performed for deterministic components only. At this time, to make the data easier to process and to simplify the calculations, as shown in FIG. 5, a spectral envelope of a deterministic component is considered to consist of a gradient component, expressed by a straight line or exponential function, and a resonance component, expressed by an exponential or other function. Here, the strength of the resonance component is calculated based on the gradient component, and a spectral envelope is expressed by adding the gradient component and resonance component. In other words, the deterministic component is expressed as a function that describes the spectral envelope using the gradient and resonance components. Here, the value of the gradient component, extended up to 0 Hz, is called the gradient component gain.

Figure 6:
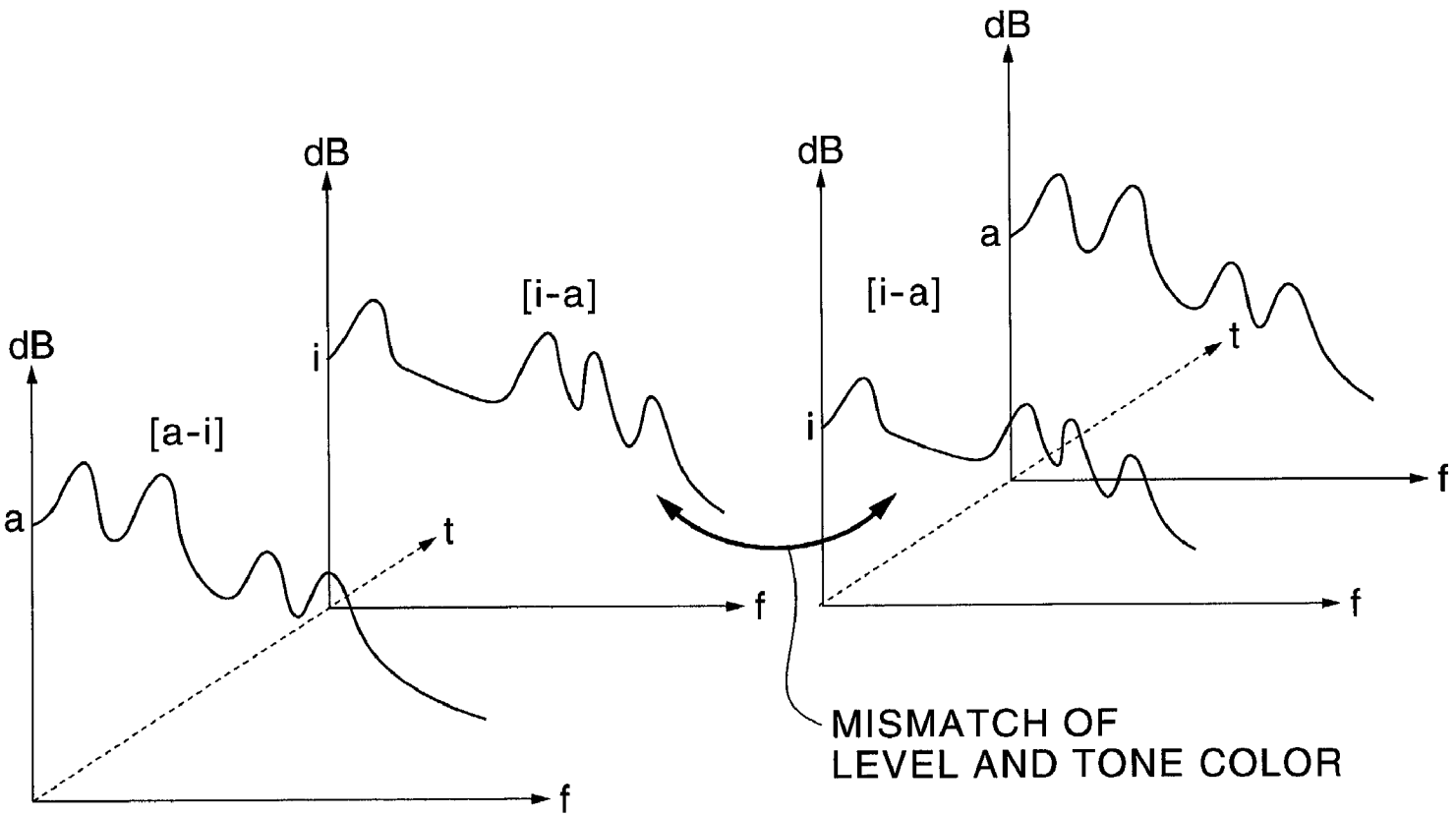
FIG. 6 is a diagram useful in explaining a mismatch at a fragment data concatenation boundary.

Next, the two fragments of "a-i" and "i-a" as shown in FIG. 6 are to be concatenated. Because these individual fragments have been collected from separate recordings, there is a mismatch in tone color and level of "i" at the concatenation boundary. As shown in FIG. 6, this creates a bump in the waveform at the concatenation boundary, and will be heard as noise. However, at a concatenation boundary, a bump can be eliminated and noise prevented by cross-fading individual parameters of the gradient and resonance components, which are included in each fragment, over several frames centered on and extending before and after the concatenation boundary.

Figure 7:
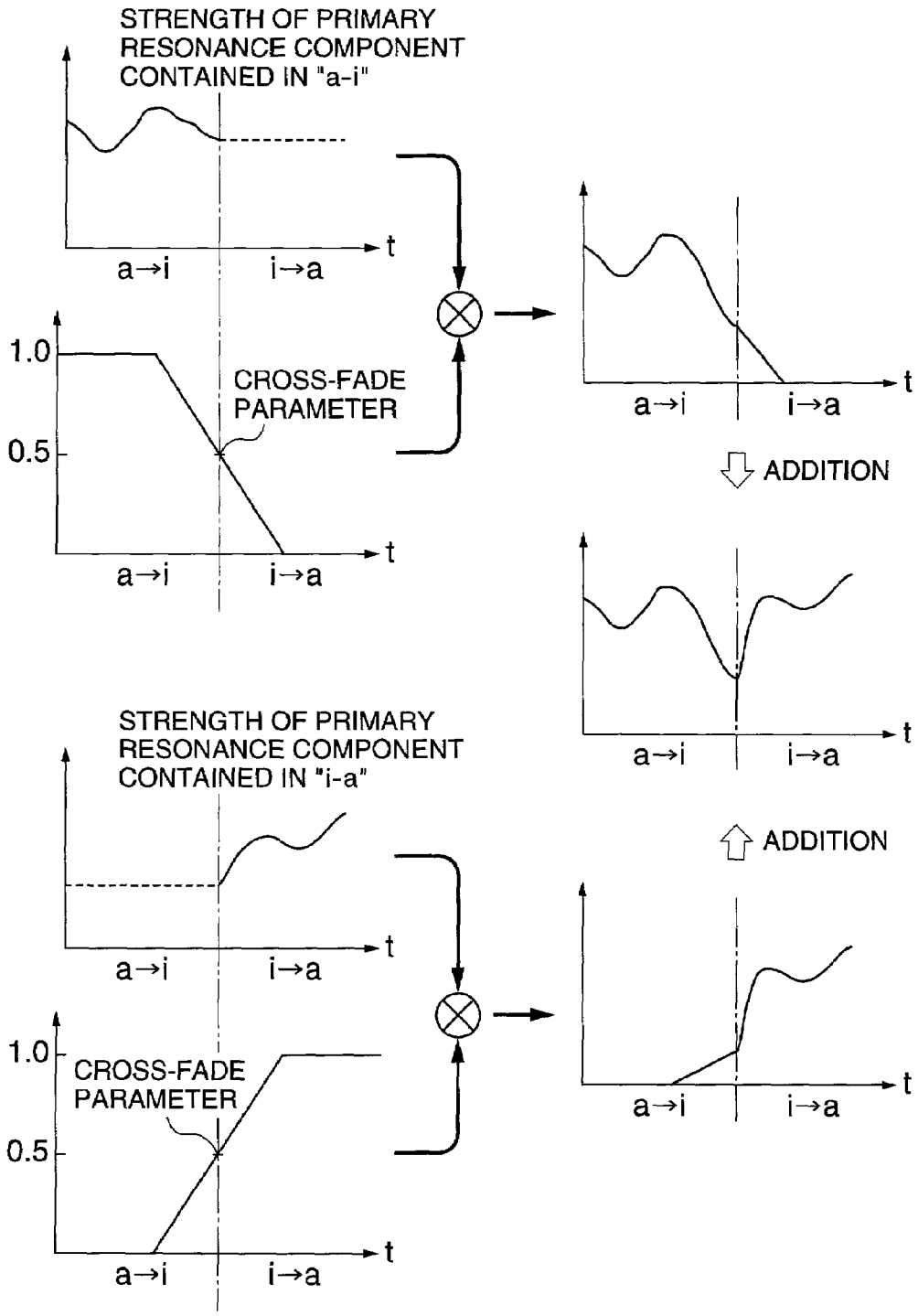
FIG. 7 is a diagram illustrating a smoothing process in the singing voice synthesizing apparatus of the present invention.

As shown in FIG. 7, to cross-fade the parameters, each fragment parameter is multiplied by a function that becomes 0.5 at the concatenation boundary, and then the parameters are added together. The example of FIG. 7 shows the changing strengths of of primary resonance components of the "a-i" and "i-a" fragments (based on the gradient component), and how the primary components are cross-faded.

In this manner, noise at the concatenation boundary between fragments can be avoided by multiplying each parameter (each resonance component, in this case) by a cross-fade parameter, and then adding them up.

Instead of performing the above described cross-fading, the levels of individual deterministic and stochastic components of fragments may be adjusted so as to make the fragment amplitudes before and after the concatenation boundary nearly equal. The level adjustment can be performed by multiplying the amplitude of each fragment by either a constant or time-varying coefficient.

An example of level adjustment will now be described for the case where "a-i" and "i-a" are to be concatenated and synthesized similarly to the above case.

Here, the matching of the gain of the gradient component of each of the fragments will be considered.

Figure 8A:
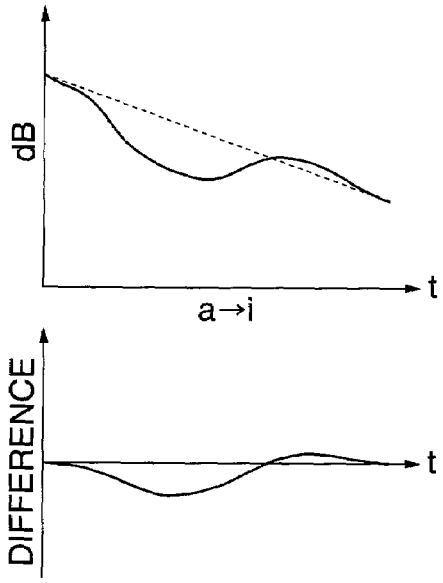
Figure 8B:
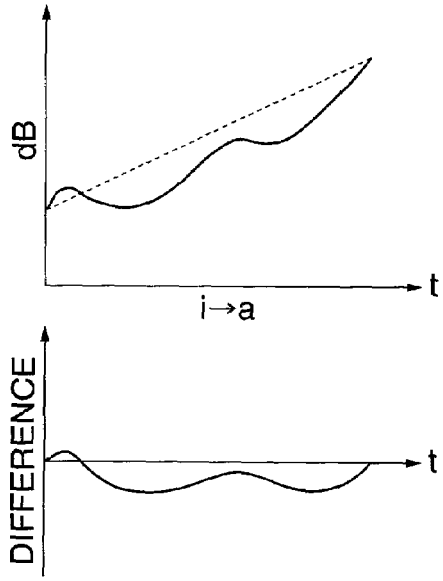

As shown in FIGS. 8A and 8B, first, the difference between the gain of the actual gradient component of each of the fragments "a-i" and "i-a" and a gain obtained by linearly interpolating gain values between the first and last frames (shown as a dashed line in the figures) of each fragment is calculated.

Next, typical samples (of the parameters of the gradient and resonance components) of each of "a" and "i" phonemes are obtained. The "a-i" data of the first and last frames may be used to obtain these typical samples, for example.

Figure 8C:
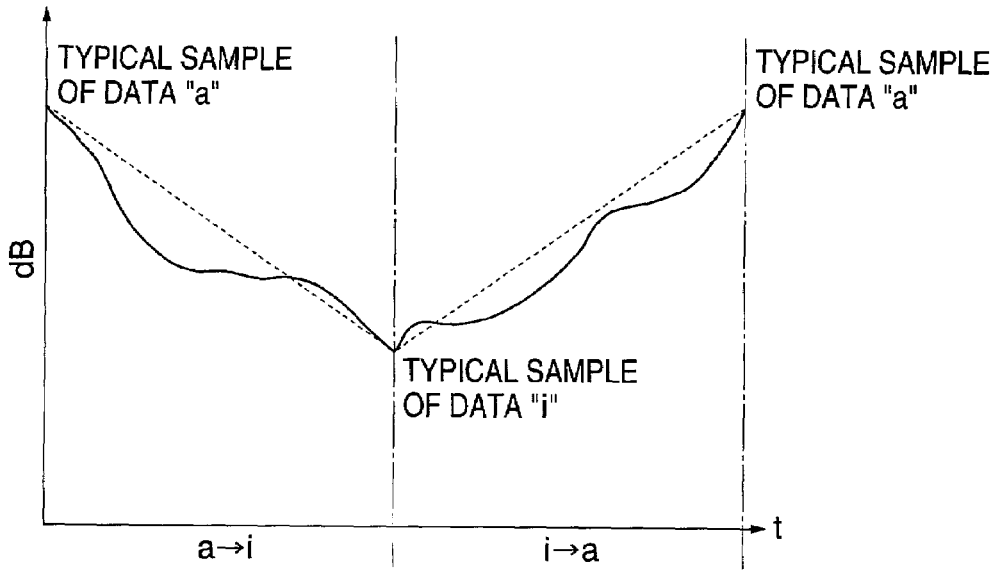

Based on these typical samples, a linear interpolation of the value of the parameter, e.g. gain, of the gradient component is performed first. Next, by sequentially adding together the results of the interpolation and the above calculated gain difference, as shown in FIG. 8C, the values of the gradient component parameter of the two fragments will be equal at the boundary, and therefore, there will be no discontinuity in the gain of the gradient component. Discontinuities in other parameters, such as the resonance component, can also be prevented in a similar manner.

Alternatively to the above described method, the level adjustment may be performed, for example, by transforming deterministic component data into waveform data and then adjusting the levels in the time domain.

After the fragment level adjusting means 25 performs the above described smoothing or level adjusting between fragments, the fragment concatenating means 26 concatenates the fragments.

Next, the deterministic component generating means 27 generates a harmonic series that corresponds to the desired pitch, while preserving the obtained deterministic component spectral envelope, whereby the actual deterministic component is obtained. By adding the stochastic component to the actual deterministic component, a synthesized singing sound is obtained, which is then transformed into a time domain signal. For example, in the case where both the deterministic component and the stochastic component are stored as frequency components, the both components are added together, and the resulting sum is subjected to an inverse FFT and applying windowing and overlapping, whereby a synthesized waveform is obtained.

It should be noted that the deterministic component and the stochastic component may be subjected to an inverse FFT and apply windowing and overlapping separately for each component, and then the thus processed components may be added together. Moreover, a sine wave corresponding to each harmonic of the deterministic component may be generated, which is then added to a stochastic component obtained by performing an inverse FFT and applying windowing and overlapping.

Figure 9A:
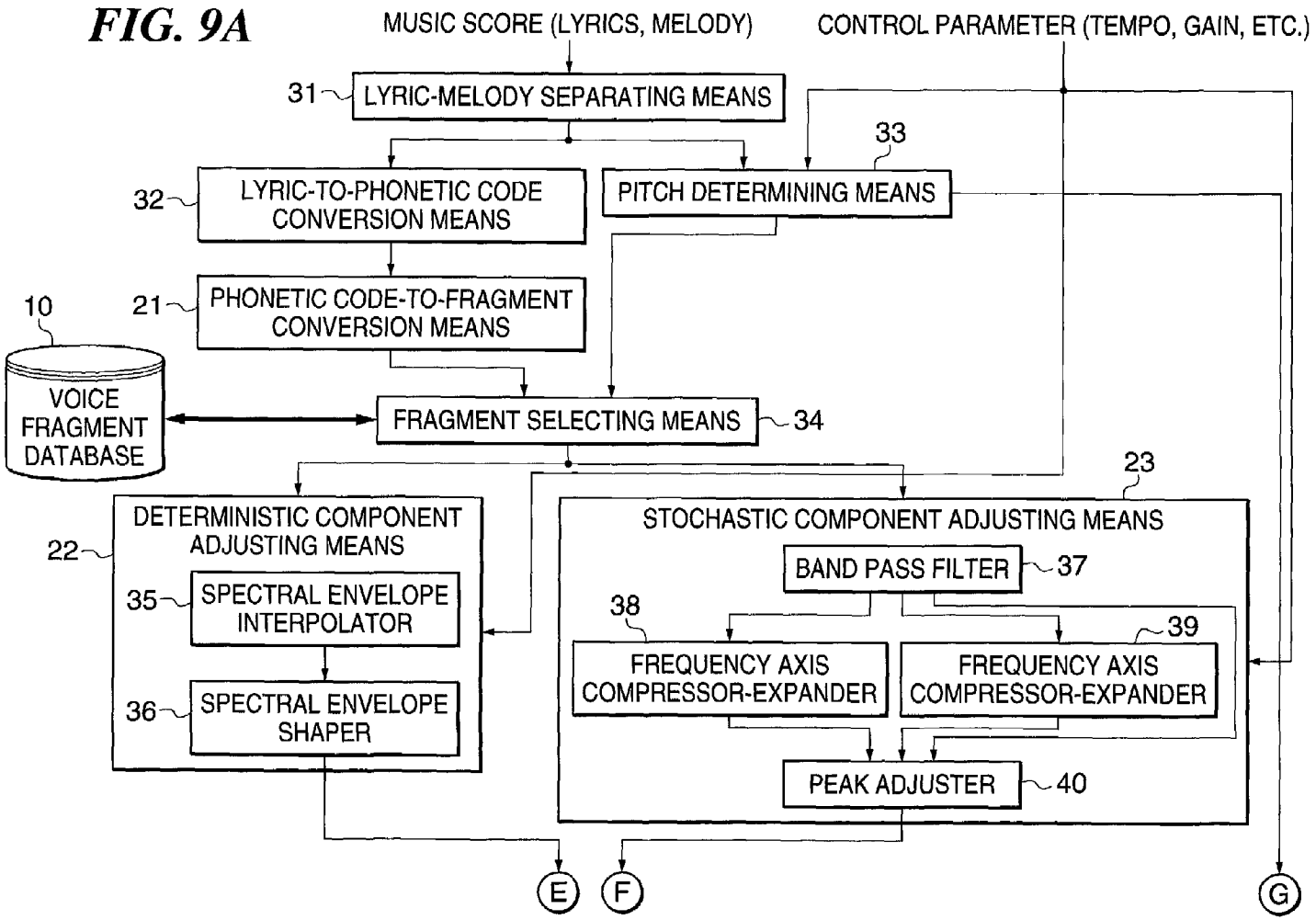
FIGS. 9A and 9B is a function block diagram illustrating a detailed configuration of a singing voice synthesizing apparatus according to an embodiment of the present invention.
Figure 9B:
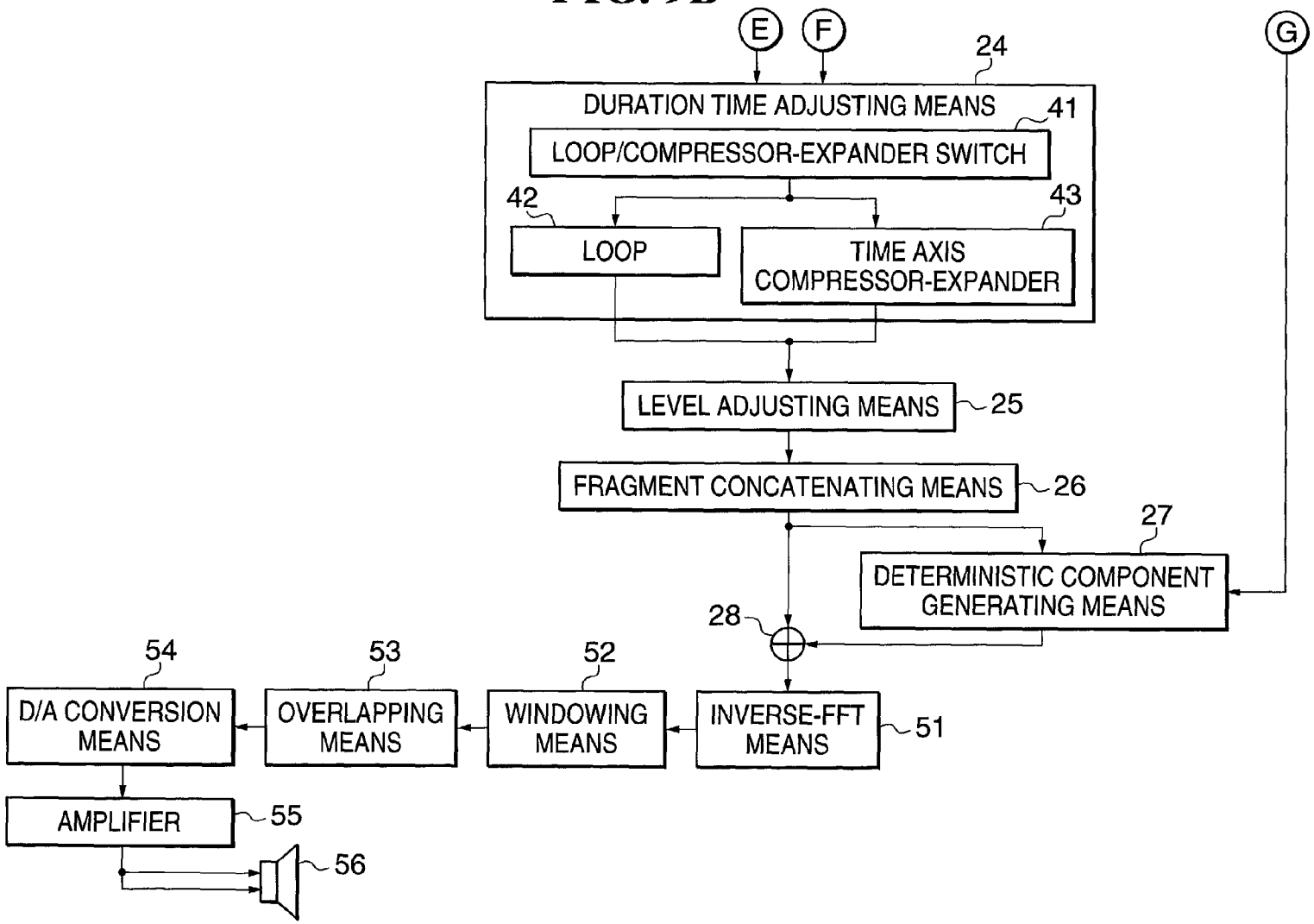

FIGS. 9A and 9B is a functional block diagram illustrating, in greater detail than FIGS. 2A and 2B, the configuration of the singing voice synthesizing apparatus according to the present embodiment. In FIGS. 9A and 9B, the same elements and parts as in FIGS. 2A and 2B are designated by identical reference numerals. Moreover, in the illustrated example, the phoneme (voice fragment) database 10 contains deterministic components which include amplitude spectral envelope information thereof for each frame, and stochastic components which include amplitude spectral envelope information and phase spectral envelope information thereof for each frame.

In FIGS. 9A and 9B, reference numeral 31 designates a lyric-melody separating means that separates lyric data and melody data from the music score data of a song for which a singing voice is to be synthesized, and 32 a lyric-to-phonetic code conversion means that converts the lyric data from the lyric-melody separating means 31 into a string of phonetically coded data (phonemes). A phoneme string from the lyric-to-phonetic code conversion means 32 is input to the phoneme (phonetic code)-to-fragment conversion means 21. Various control parameters, such as tempo, may be input to control the musical performance. Pitch information and dynamics information such as dynamic marks that has been separated from the music score data by the lyric-melody separating means 31, and the control parameters are input to a pitch determining means 33, which in turn determines the pitch, dynamics, and tempo of the signing sound. Fragment information from the phoneme-to-fragment conversion means 21 and information such as pitch, dynamics, and tempo from the pitch determining means 33 are fed to a fragment selecting means 34. The fragment selecting means 34 searches the voice fragment database (phoneme database) 10 and outputs the most suitable fragment data. At this time, if there is stored no fragment data that completely matches the search conditions, data of one or a plurality of similar fragments is read out.

Deterministic component data included in the fragment data output from the fragment selecting means 34 is fed to the deterministic component adjusting means 22. In the case where a plurality of fragment data have been read out by the fragment selecting means 34, a spectral envelope interpolator 35 within the deterministic component adjusting means 22 performs interpolation so that the search conditions are satisfied, and as necessary, a spectral envelope shaper 36 changes the shape of the spectral envelope according to the control parameters.

On the other hand, stochastic component data included in the fragment data output from the fragment selecting means 34 is input to the stochastic component adjusting means 23. This stochastic component adjusting means 23 is supplied with pitch information from the pitch determining means 33, and as was described with reference to FIG. 3, compresses or expands the frequency axis for low frequency stochastic components according to a desired pitch. Namely, a band pass filter 37 divides the amplitude spectrum and phase spectrum of a stochastic component into the three regions of low frequency, mid-frequency and high frequency. Frequency axis compressor-expanders 38 and 39 compress or expand the frequency axis according to the desired pitch for the low frequency and mid-frequency regions, respectively. Low and mid-frequency region signals resulting from the frequency axis compression or expansion, and a high frequency region signal based on the high frequency region for which no frequency axis compression or expansion has been performed, are fed to a peak adjuster 40 where peak values of these signals are adjusted so as to preserve the shape of the spectral envelope of this stochastic component.

The deterministic component data from the deterministic component adjusting means 22 and the stochastic component data from the stochastic component adjusting means 23 are input to the duration time adjusting means 24. Then, the duration time adjusting means 24 changes the time length of the fragment according to a sounding time length which is determined by the melody information and the tempo information. As previously described, in the case where the duration time of the fragment is to be made shorter, the time axis compressor-expander 43 performs the process of thinning out frames, and in the case where the duration time is to be made longer, a loop section 42 performs the loop processing described with reference to the FIGS. 4A to 4C.

The fragment data whose duration time has been adjusted by the duration time adjusting means 24 is subjected to a level adjusting process by the fragment level adjusting means 25 as described previously with reference to the FIGS. 5 through 8C, and the deterministic components and stochastic components of the level adjusted fragment data are each concatenated into respective time series by the fragment concatenating means 26.

The deterministic components (spectral envelope information) of the fragment data concatenated by the fragment concatenating means 26 are input to the deterministic component generating means 27. This deterministic component generating means 27 is supplied with pitch information from the pitch determining means 33, and based on the spectral envelope information, generates harmonic components corresponding to the pitch information from which the actual deterministic component for each frame is obtained.

Next, the adder 28 synthesizes a frequency domain signal for each frame by combining stochastic component amplitude and phase spectral envelope information from the fragment concatenating means 26 with deterministic component amplitude spectrum information from the deterministic component generating means 27.

Then, the frequency domain signal for each frame thus synthesized is transformed by an inverse Fourier transform means (inverse FFT means) 51 into a time domain waveform signal. Next, a windowing means 52 multiplies the time domain waveform signal by a windowing function that corresponds to the frame length, and an overlap means 53 synthesizes a time waveform signal by overlapping the time domain waveform signals for respective frames.

Then, a D/A conversion means 54 converts the thus-synthesized time waveform signal into an analog signal that is output via an amplifier 55 to a speaker 56 to be sounded therefrom.

Figure 10:
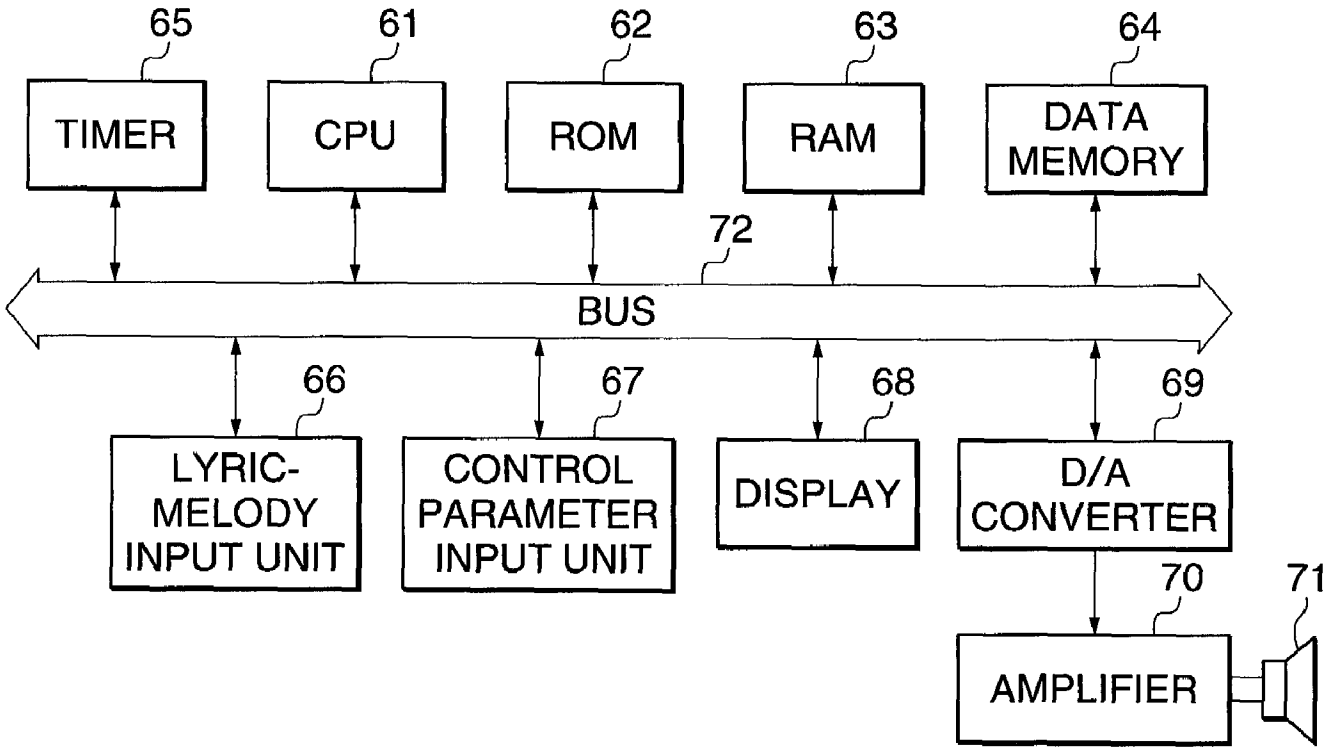
FIG. 10 is a diagram illustrating an example of the construction of a hardware apparatus used to operate a singing voice synthesizing apparatus of the present invention.

FIG. 10 illustrates an example of the construction of a hardware apparatus used to operate the specific example shown in FIGS. 9A and 9B. In the figure, reference numeral 61 designates a central processing unit (CPU) that controls the overall operation of the singing voice synthesizing apparatus, 62 a ROM that stores various programs, constants and other data, 63 a RAM that stores a work area and various data, 64 a data memory, 65 a timer that generates prescribed timer interrupts or the like, 66 a lyric-melody input unit that inputs music score, lyric and other data of a song to be performed, 67 a control parameter input unit that inputs various control parameters related to the performance, 68 a display that displays various types of information, 69 a D/A converter that converts the synthesized singing voice data into an analog signal, 70 an amplifier, 71 a speaker, and 72 a bus that interconnects all the above-mentioned component elements.

The phoneme database 10 is loaded into the ROM 62 or the RAM 63. A singing sound is synthesized in the above described manner according to the data input by the lyric-melody input unit 66 and the control parameter input unit 67, and a singing sound is output from the speaker 71.

The construction of the hardware apparatus of FIG. 10 is identical with that of an ordinary general-purpose computer. The above described functional blocks of the singing voice synthesizing apparatus of the present invention may also be realized by an application program executed by a general-purpose computer.

In the above described embodiment, the fragment data stored in the database 10 is SMS data, which is typically comprised of a spectral envelope of the deterministic component for each unit time (frame), and amplitude and phase spectral envelopes of the stochastic component for each frame. As described above, by storing fragment data of elongated sounds, such as long vowels, a high-quality singing sound can be synthesized. However, especially in the case of elongated sounds, there is the problem of large data sizes due to the storage of deterministic and stochastic components for each time instance (frame) during the interval of the elongated sound.

In the case of deterministic components, it is sufficient to store data for each frequency that is an integer multiple of the fundamental pitch. For example, if the fundamental pitch is 150 Hz and the maximum frequency is 22025 Hz, the amplitude (or phase) data of the 150 Hz frequency must be stored. On the other hand, in the case of stochastic components, a much larger quantity of data are required, that is, the amplitude spectral envelope and phase spectral envelope must be stored for all frequencies. If 1024 points are sampled within a frame, the amplitude and phase data for 1024 frequencies is required. Especially in the case of elongated sounds, the quantity of data becomes extremely large since data must be stored for all frames within the interval of the elongated sound. Moreover, the data of the elongated sound interval must be provided for each of individual phonemes, and as described above, the data should desirably be provided for each of various pitches to increase naturalness, but this leads to a further increase in the quantity of data in the database.

Therefore, another embodiment of the present invention, which enables the size of the database to be made extremely small, will be described below. According to this embodiment, a means is added for whitening the spectral envelope when storing stochastic component data of elongated sounds to generate the database 10. Also, a means for generating a stochastic component spectral envelope during synthesis of a singing sound is provided within the stochastic component adjusting means. Thus, the data size can be reduced because it is unnecessary to store individual spectral envelopes of the stochastic components of elongated sounds.

Figure 11:
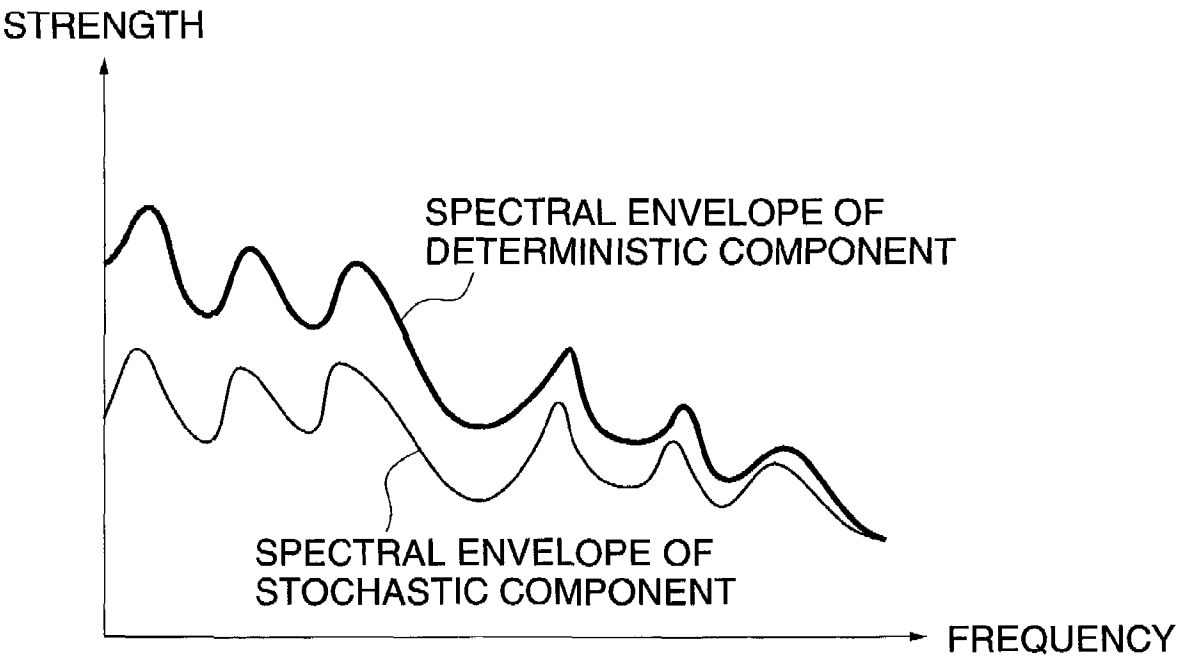
FIG. 11 is a diagram illustrating an example of spectral envelopes of deterministic and stochastic components of an elongated sound.

FIG. 11 shows an example of spectral envelopes of the deterministic and stochastic components of an elongated sound. As shown in the figure, in the case of an elongated sound, the spectral envelope of the stochastic component generally resembles that of the deterministic component. Namely, the locations of peaks and valleys are roughly aligned. Therefore, a suitable stochastic component spectral envelope can be obtained by performing some arbitrary processing (such as gain adjustment, adjustment of the overall gradient, etc.) on the spectral envelope of the deterministic component.

Moreover, in the case of an elongated sound, each frequency component in each frame within a certain interval to be processed has a slight fluctuation that is important. The degree of this fluctuation is not considered to change much even when a vowel changes. Therefore, an amplitude spectral envelope of a stochastic component is flattened in advance by some means (whitening) to eliminate the influence of the tone color of the original vowel. The spectrum appears flat due to the whitening. Then, at the time of synthesis, a spectral envelope of the stochastic component is determined based on the shape of the spectral envelope of the deterministic component and the determined stochastic component spectral envelope is multiplied by the whitened spectral envelope to obtain an amplitude spectrum of the stochastic component. In other words, only the spectral envelope of the stochastic component is generated based on the deterministic component spectral envelope, while the phase included in the original stochastic component of the elongated sound, is used as it is. In this manner, stochastic components of different elongated vowel sound data can be generated based on whitened elongated sound data.

Figure 12:
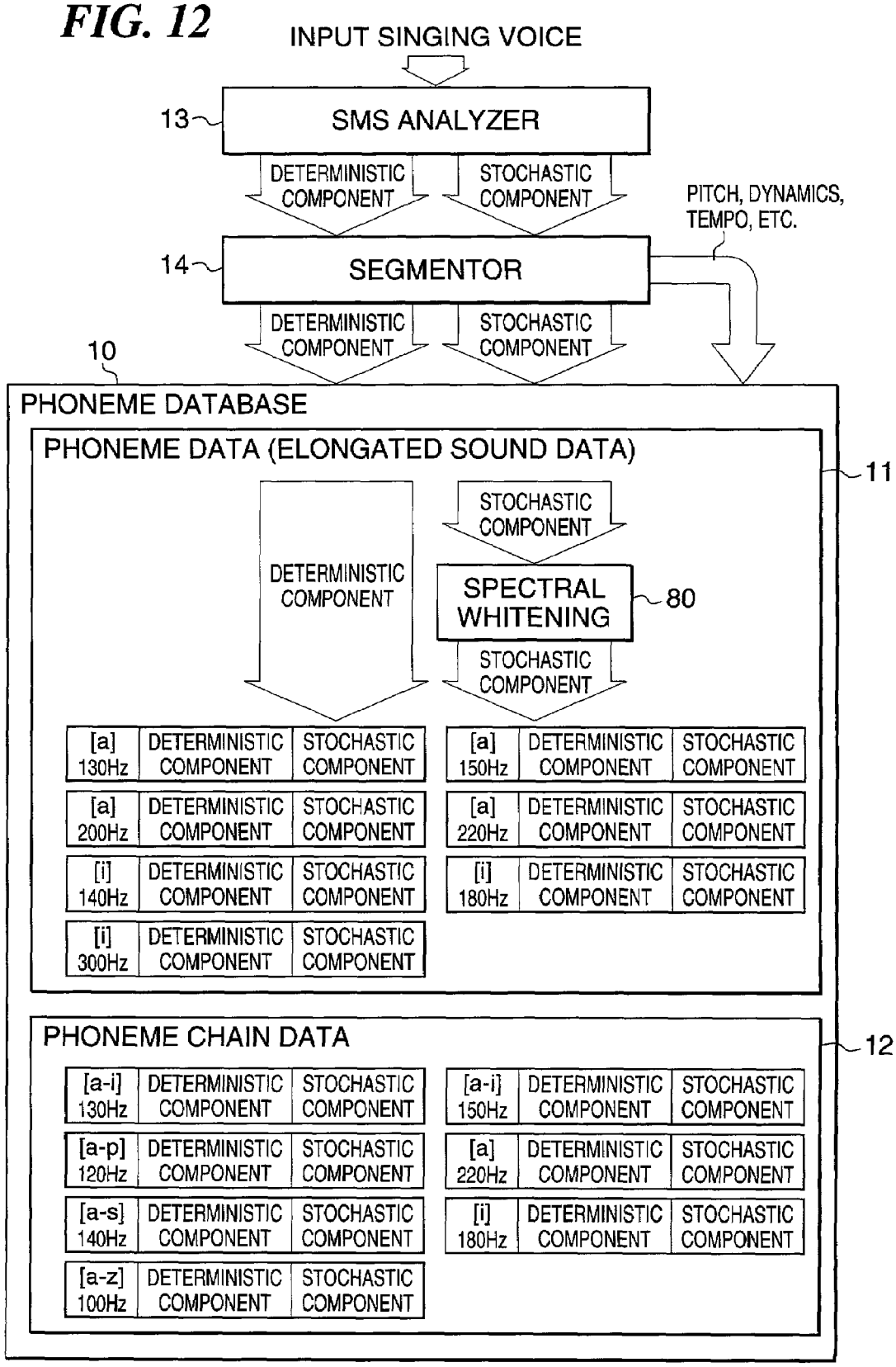
FIG. 12 is a diagram illustrating a process for generating a phoneme database carried out by a singing voice synthesizing apparatus according to another embodiment of the present invention.

FIG. 12 illustrates a process for generating the phoneme database 10 according to this embodiment. In the figure, component elements and parts corresponding to those in FIG. 1 are designated by identical reference numerals, description of which is omitted. As shown in FIG. 12, for elongated sounds, this embodiment has a spectral whitening means 80 that whitens the amplitude spectrum of a stochastic component having been output from the segmentor 14. Therefore, the only data stored are the whitened amplitude spectrum, as the amplitude spectrum of a stochastic component of the elongated sound, and the phase spectrum, as the stochastic component of each fragment data.

Figure 13:
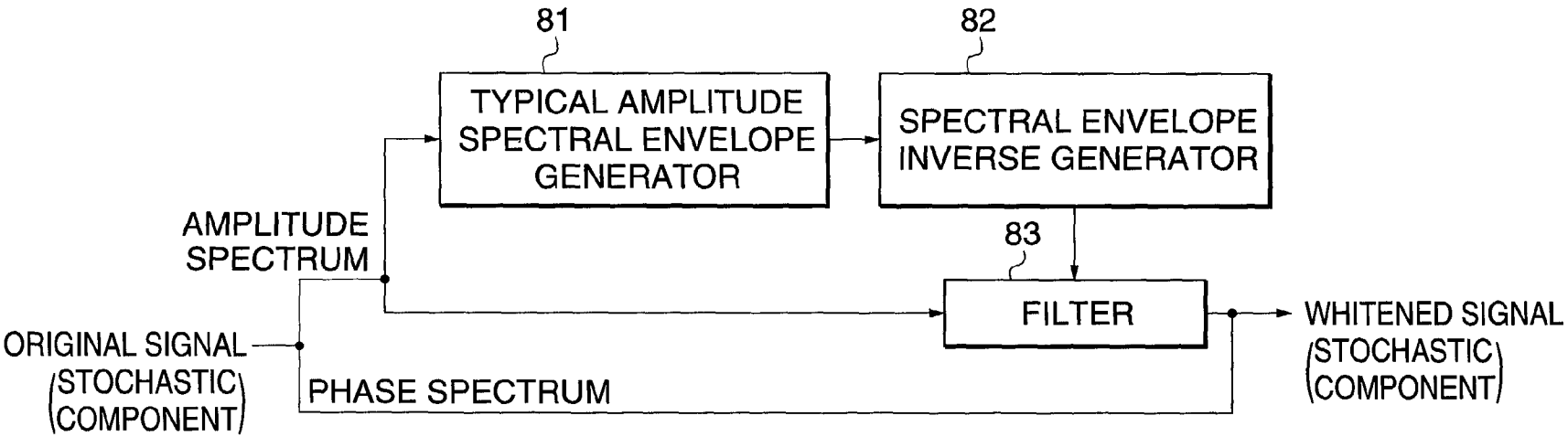
FIG. 13 is a diagram illustrating an example of the configuration of a spectral whitening means.

FIG. 13 shows an example of the configuration of the spectral whitening means 80.

As previously noted, the stochastic component amplitude spectrum of an elongated sound is whitened by this spectral whitening means 80, and appears flat. However, at this time, the spectral envelopes of all frames within an interval for processing are not made completely flat (i.e. not the same spectral value at all frequencies). It is important that the small temporal fluctuations of each frequency be retained while making the spectral envelope shape in each frame nearly flat. To this end, as shown in FIG. 13, a typical amplitude spectral envelope generator 81 generates a typical envelope of the amplitude spectrum within an interval for processing, a spectral envelope inverse generator 82 generates the inverse of each frequency component of the spectral envelope, and a filter 83 multiplies the output of the spectral envelope inverse generator 82 by individual frequency components of the spectral envelope of each frame.

Here, a typical envelope of an amplitude spectrum within the interval may also be generated, for example, by calculating an average value of the amplitude spectrum for each frequency and using those average values as the typical spectral envelope. Alternatively, the maximum value of each frequency component within the interval may be used as the typical spectral envelope.

As a result, whitened amplitude spectra can be obtained from the filter 83. Moreover, the phase spectra are stored directly as stochastic component information of the fragment.

In this manner, the stochastic component of an elongated sound is whitened, and the spectral envelope of the deterministic component is used during synthesis to generate the stochastic component. Therefore, if the whitened stochastic component is a stochastic component, it can be used commonly for all vowels. In other words, in the case of a vowel, a single whitened stochastic component of an elongated sound is sufficient. Of course, a plurality of whitened stochastic components may be provided.

Figure 14A:
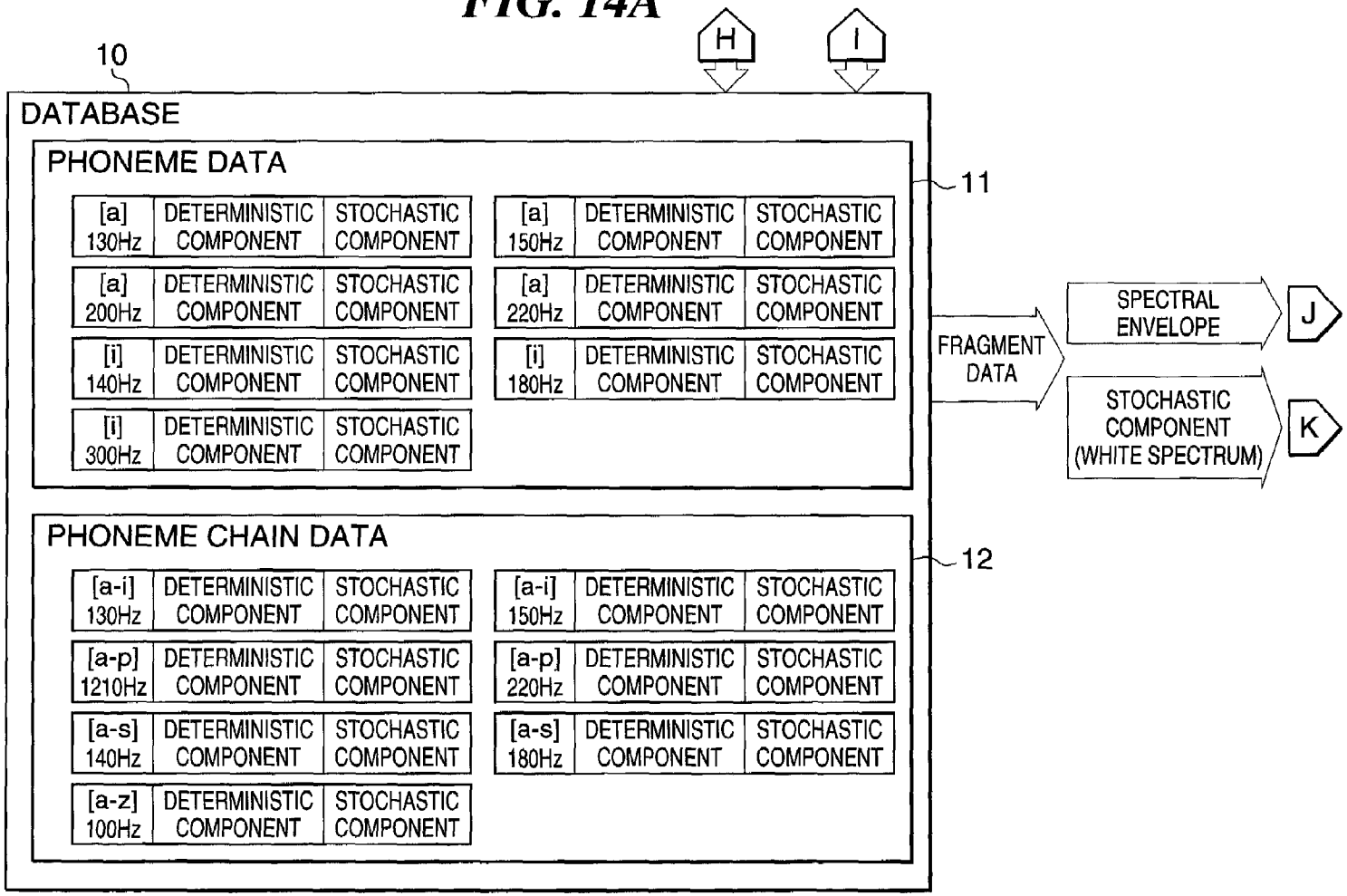
FIGS. 14A and 14B is a diagram illustrating a singing voice synthesis process carried out by the singing voice synthesizing apparatus according to the other embodiment of the present invention.
Figure 14B:
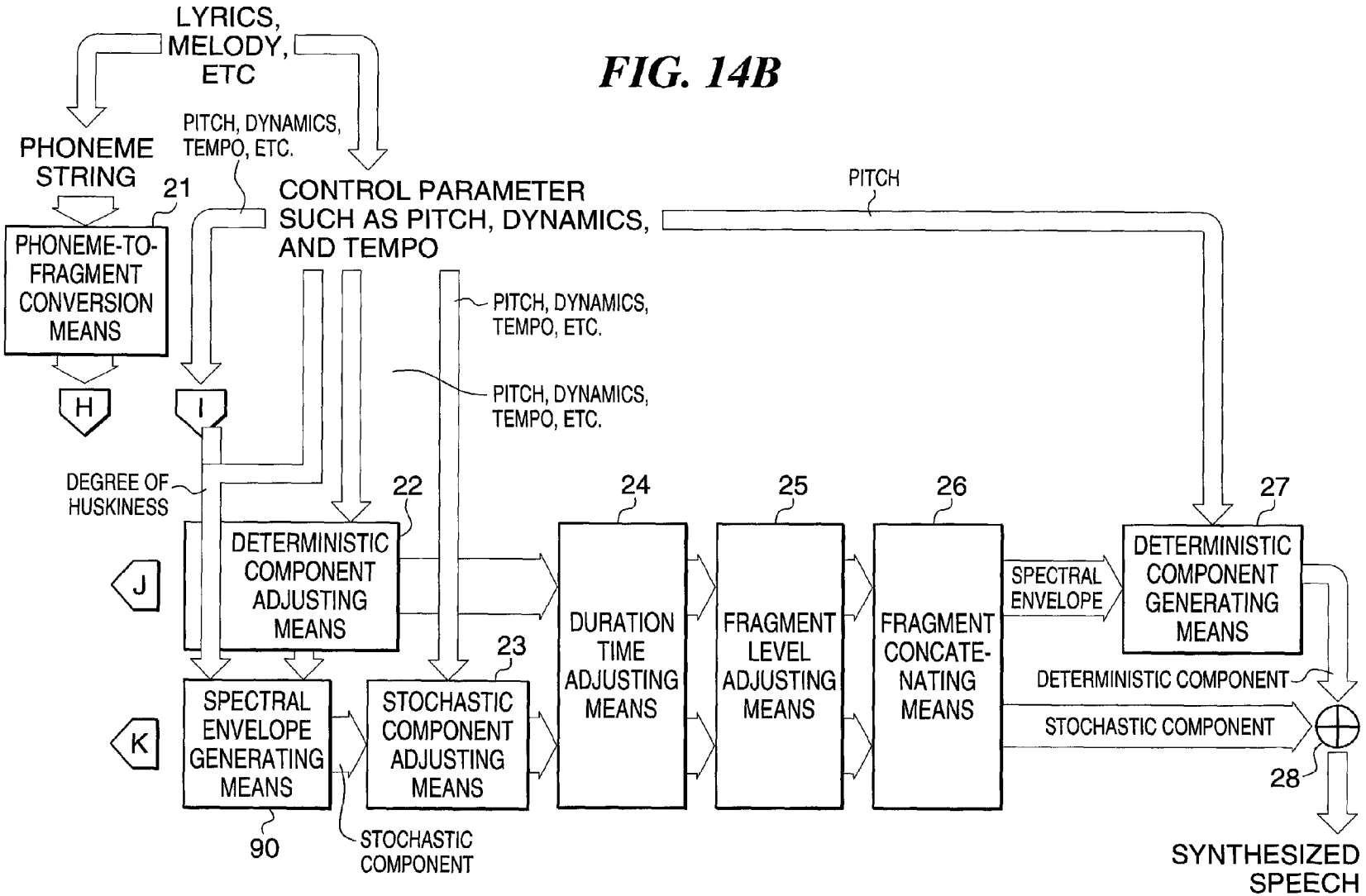

FIGS. 14A and 14B illustrates a synthesis process which is executed in the case where the whitened amplitude spectra of the stochastic components of elongated sounds are stored in the above described manner. In the figure, component elements and parts corresponding to those in FIGS. 2A and 2B are designated by identical reference numerals, description of which is omitted. As shown in the figure, according to this embodiment, a spectral envelope generating means 90, to which are input stochastic components (whitened amplitude spectra) of fragments that have been read out from the database 10, is added on the upstream side of the stochastic component adjusting means 23.

When the whitened stochastic component of an elongated sound is read out from the phoneme database 10, the spectral envelope generating means 90 calculates the amplitude spectral envelope of the stochastic component based on the spectral envelope of the deterministic component, as described above. For example, a method a method is considered, in which, assuming that the component at the maximum frequency does not change, the amplitude spectral envelope of the stochastic component is determined by changing only the gradient of the spectral envelope.

Then, the determined amplitude spectral envelope, together with the phase spectrum of the stochastic component that has been read at the same time, are input to the stochastic component adjusting means 23. The subsequent processing is the same as was illustrated in FIGS. 2A and 2B.

As described above, when the amplitude spectra of stochastic components of elongated sounds are to be whitened and stored, the whitened amplitude spectra of stochastic components of some of the elongated sounds may be stored, while the amplitude spectra of stochastic components of the other elongated sounds are not stored.

In this case, if one of the other elongated sounds is to be synthesized, the amplitude spectra of the stochastic components of this elongated sound are not included in the fragment data of the elongated sound. Thererefore, a phoneme that most closely resembles the phoneme to be synthesized is extracted from the database. Using the stochastic components of the elongated sound, amplitude spectra of the stochastic components may be generated in the above described manner.

Moreover, phonemes from which elongated sounds can be generated may be divided into one or more groups, and using one of elongated sound data belonging to the group affiliated with the phoneme to be synthesized, amplitude spectra of the stochastic components may be generated in the above described manner.

Further, when using the amplitude spectra of stochastic components obtained from the whitened amplitude spectra and the amplitude spectra of deterministic components, all or a part of the frequency axes of the stochastic component phase spectra are shifted so that data indicative of harmonics and their vicinities corresponding to the pitch of the original data becomes indicative of harmonics and their vicinities corresponding to the desired pitch at which the sound is to be reproduced. In other words, a more natural synthesized sound can be obtained by using the phase data indicative of harmonics and their vicinities as it is during synthesis.

According to this embodiment, the database does not have to store an elongated sound stochastic component for every vowel, and therefore the quantity of data can be reduced.

Furthermore, in the case where the spectral envelope of the stochastic component is determined by changing only the gradient of this spectral envelope, the "degree of huskiness" of the synthesized voice can be controlled by correlating the change in gradient with huskiness.

Figure 15:
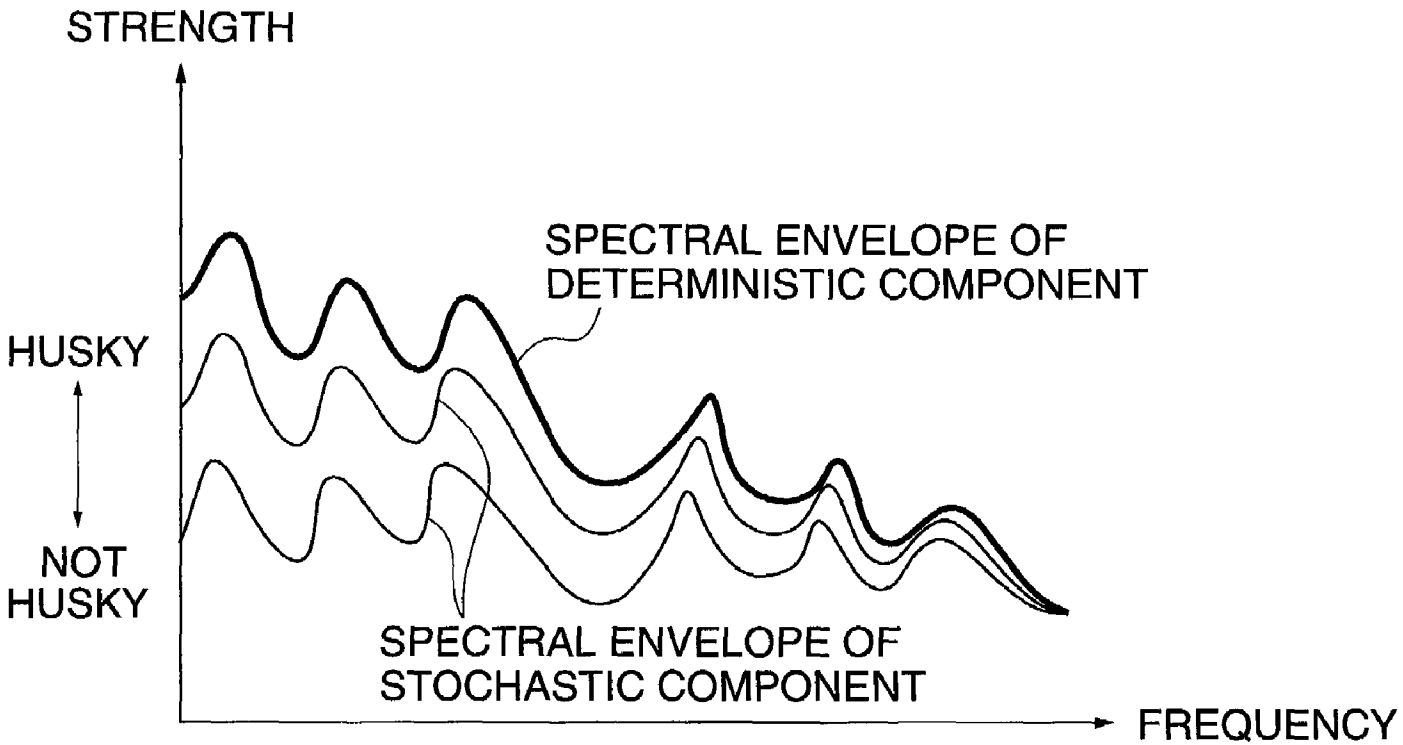
FIG. 15 is a diagram useful in explaining the control of huskiness.

More specifically, the synthesized voice will be husky if it contains many stochastic components, and will be smooth if it contains few stochastic components. Therefore, if the gradient is steep (the gain at 0 Hz is large), the voice will be husky, and if the gradient is slight (the gain at 0 Hz is small), the voice will be smooth. Therefore, as shown in FIG. 15, the gradient of the spectral envelope of the stochastic component is controlled according to a parameter that expresses the degree of huskiness, to thereby control the huskiness of the synthesized voice.

Figure 16:
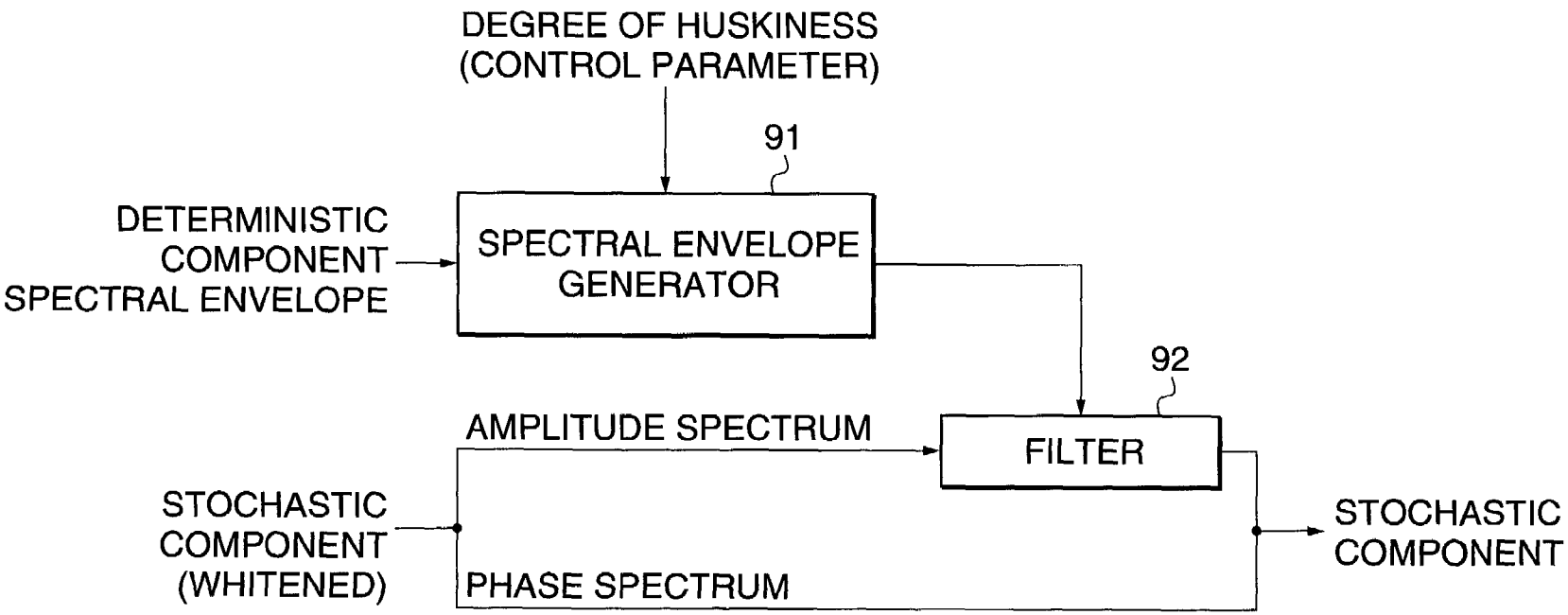
FIG. 16 is a diagram illustrating an example of the configuration of a spectral envelope generating means that is adapted to control huskiness.
Figure 17:
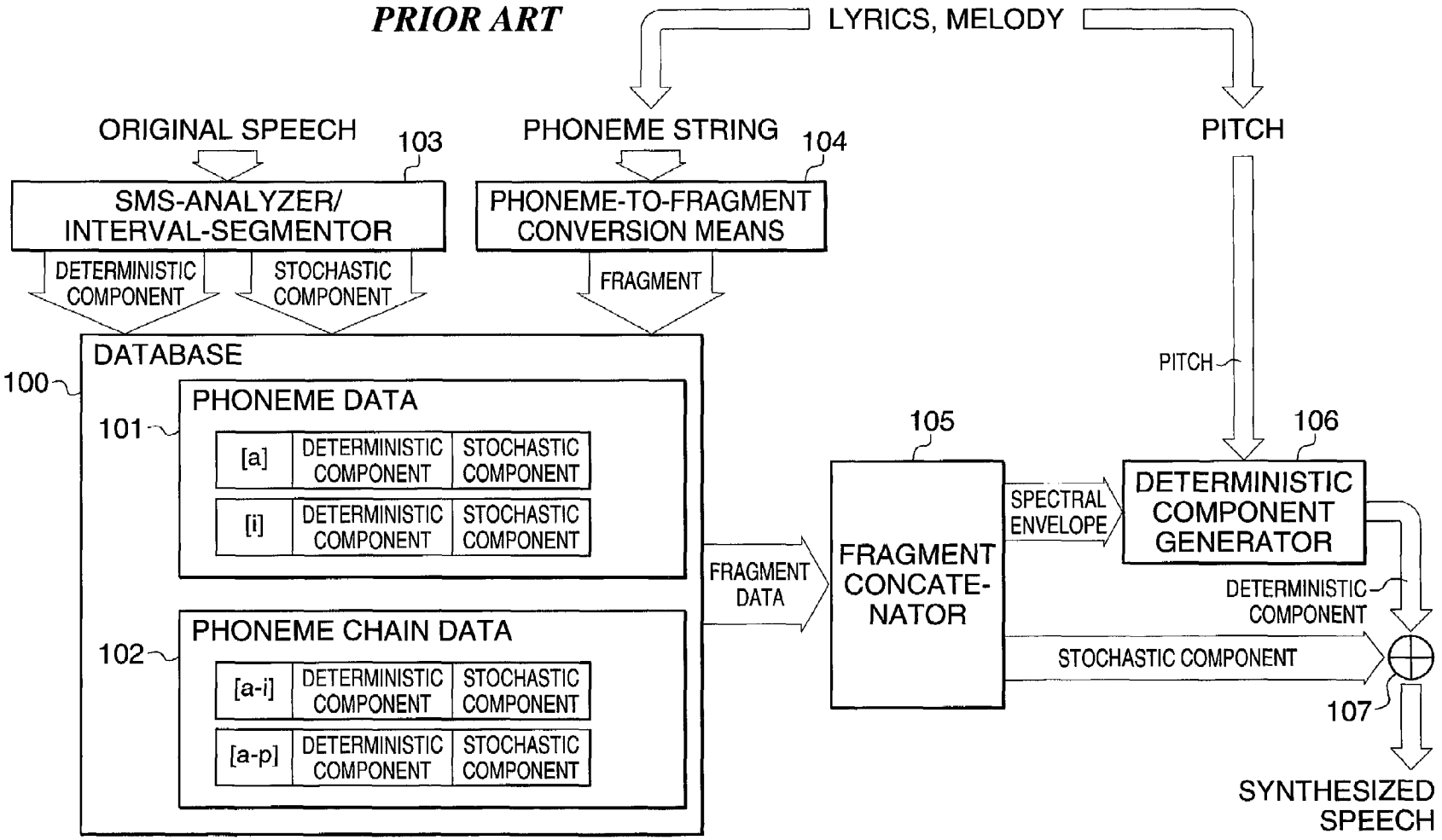
FIG. 17 PRIOR ART
FIG. 17 is a diagram illustrating the construction of a singing voice synthesizing apparatus that employs the conventional SMS method.

FIG. 16 shows an example of the configuration of the spectral envelope generating means 90 which is adapted to control the degree of huskiness. A spectral envelope generator 91 multiplies the spectral envelope of the deterministic component by a gradient value that corresponds to the huskiness information supplied as a control parameter. A filter 92 adds characteristics thus obtained to the whitened amplitude spectrum of the stochastic component. Then, the phase spectral envelope of the stochastic component and the output from the filter 92 are fed as stochastic component data to the stochastic component adjusting means 23.

It is also possible to model the spectral envelope of the deterministic component in a suitable manner and correlating a parameter of the model and the degree of huskiness. For example, the spectral envelope of the stochastic component may also be calculated by correlating the degree of huskiness and any one of parameters (a parameter related to gradient) used in formularizing the spectral envelope of the deterministic component ,by changing the parameter.

Furthermore, the degree of huskiness may be constant or may be varied over time. In the case of time-varying huskiness, an interesting effect can be obtained wherein a voice becomes gradually more husky during the elongation of a phoneme.

Moreover, for the sole purpose of controlling the degree of huskiness, it is unnecessary to store the whitened amplitude spectrum of a stochastic component in the phoneme database 10 as described above. As in the first embodiment described above, the amplitude spectrum of the stochastic component of an elongated sound is stored as it is, similarly as for other fragments. During synthesis, a flat spectrum is generated by obtaining a typical amplitude spectrum within the elongated sound interval, and multiplying the inverse thereof by the amplitude spectrum of the stochastic component. Then, based on the amplitude spectrum of the deterministic component, the amplitude spectrum of the stochastic component is calculated according to the parameter that controls the degree of huskiness. The flat spectrum is then multiplied by the calculated amplitude spectrum of the stochastic component to obtain the amplitude spectrum of the stochastic component.

What is claimed is:

1. A singing voice synthesizing apparatus comprising:

a phoneme database that stores a plurality of voice fragment data formed of voice fragments each being a single phoneme or a phoneme chain of at least two concatenated phonemes, each of the plurality of voice fragment data comprising data of a deterministic component and data of a stochastic component;

an input device that inputs lyrics;

a readout device that reads out from said phoneme database the voice fragment data corresponding to the inputted lyrics;

a duration time adjusting device that adjusts time duration of the read-out voice fragment data so as to match a desired tempo and manner of singing;

an adjusting device that adjusts the deterministic component and the stochastic component of the read-out voice fragment so as to match a desired pitch, said adjusting device being configured to adjust the stochastic component by varying a low frequency region of an amplitude spectrum of the stochastic component according to the desired pitch; and a synthesizing device that synthesizes a singing sound by sequentially concatenating the voice fragment data that have been adjusted by said duration time adjusting device and said adjusting device.

2. A singing voice synthesizing apparatus according to claim 1, wherein said phoneme database stores a plurality of voice fragment data having different musical expressions for a single phoneme or phoneme chain.

3. A singing voice synthesizing apparatus according to claim 2, wherein said musical expressions include at least one parameter selected from the group consisting of pitch, dynamics and tempo.

4. A singing voice synthesizing apparatus according to claim 1, wherein said phoneme database stores voice fragment data comprising elongated sounds that are each enunciated by elongating a single phoneme, voice fragment data comprising consonant-to-vowel phoneme chains and vowel-to-consonant phoneme chains, voice fragment data comprising consonant-to-consonant phoneme chains, and voice fragment data comprising vowel-to-vowel phoneme chains.

5. A singing voice synthesizing apparatus according to claim 1, wherein each of said voice fragment data comprises a plurality of data corresponding respectively to a plurality of frames of a frame string formed by segmenting a corresponding one of the voice fragments, and wherein the data of the deterministic component and the data of the stochastic component of each of said voice fragment data each comprise a series of frequency domain data corresponding respectively to the plurality of frames of the frame string corresponding to each of the voice fragments.

6. A singing voice synthesizing apparatus according to claim 5, wherein said duration time adjusting device generates a frame string of a desired time length by repeating at least one frame of the plurality of frames of the frame string corresponding to each of the voice fragments, or by thinning out a predetermined number of frames of the plurality of frames of the frame string corresponding to each of the voice fragments.

7. A singing voice synthesizing apparatus according to claim 5, further comprising a deterministic component generating device that changes only pitch of the deterministic component to a desired pitch while preserving the spectral envelope shape of the deterministic component contained in each of the voice fragment data when the voice fragment data are sequentially concatenated by said synthesizing device.

8. A singing voice synthesizing apparatus according to claim 1, further comprising a fragment level adjusting device that performs smoothing processing or level adjusting processing on the deterministic component and the stochastic component contained in each of the voice fragment data when the voice fragment data are sequentially concatenated by said synthesizing device.

9. A singing voice synthesizing apparatus according to claim 1, wherein said adjusting device adjusts the stochastic component by using an original amplitude spectrum for a high frequency region of the amplitude spectrum of the stochastic component.

10. A singing voice synthesizing apparatus according to claim 1, wherein said adjusting device varies the low frequency region of the amplitude spectrum by compressing or expanding a frequency axis for the low frequency region of the amplitude spectrum of the stochastic component according to the desired pitch, with a general shape of the amplitude spectrum preserved.

11. A singing voice synthesizing apparatus comprising:

a phoneme database that stores a plurality of voice fragment data formed of voice fragments each being a single phoneme or a phoneme chain of at least two concatenated phonemes, each of the plurality of voice fragment data comprising data of a deterministic component and data of a stochastic component;

an input device that inputs lyrics;

a readout device that reads out from said phoneme database the voice fragment data corresponding to the inputted lyrics;

a duration time adjusting device that adjusts time duration of the read-out voice fragment data so as to match a desired tempo and manner of singing;

an adjusting device that adjusts the deterministic component and the stochastic component of the read-out voice fragment so as to match a desired pitch; and a synthesizing device that synthesizes a singing sound by sequentially concatenating the voice fragment data that have been adjusted by said duration time adjusting device and said adjusting device, wherein:

each of said voice fragment data comprises a plurality of data corresponding respectively to a plurality of frames of a frame string formed by segmenting a corresponding one of the voice fragments;

the data of the deterministic component and the data of the stochastic component of each of said voice fragment data each comprise a series of frequency domain data corresponding respectively to the plurality of frames of the frame string corresponding to each of the voice fragments; and said duration time adjusting device generates a frame string of a desired time length by repeating a plurality of frames of the frame string corresponding to each of the voice fragments, said duration time adjusting device repeating the plurality of frames in a first direction in which the frame string of a desired time length is generated and in a second direction opposite thereto.

12. A singing voice synthesizing apparatus according to claim 11, wherein when repeating the plurality of frames of the frame string corresponding to the data of the stochastic component of each of the voice fragments in the first and second directions, said duration time adjusting device reverses a phase of a phase spectrum of the stochastic component.

13. A singing voice synthesizing apparatus comprising:

a phoneme database that stores a plurality of voice fragment data formed of voice fragments each being a single phoneme or a phoneme chain of at least two concatenated phonemes, each of the plurality of voice fragment data comprising data of a deterministic component and data of a stochastic component;

an input device that inputs lyrics;

a readout device that reads out from said phoneme database the voice fragment data corresponding to the inputted lyrics;

a duration time adjusting device that adjusts time duration of the read-out voice fragment data so as to match a desired tempo and manner of singing;

an adjusting device that adjusts the deterministic component and the stochastic component of the read-out voice fragment so as to match a desired pitch; and a synthesizing device that synthesizes a singing sound by sequentially concatenating the voice fragment data that have been adjusted by said duration time adjusting device and said adjusting device, wherein;

each of said voice fragment data comprises a plurality of data corresponding respectively to a plurality of frames of a frame string formed by segmenting a corresponding one of the voice fragments;

the data of the deterministic component and the data of the stochastic component of each of said voice fragment data each comprise a series of frequency domain data corresponding respectively to the plurality of frames of the frame string corresponding to each of the voice fragments; and said phoneme database stores voice fragment data comprising elongated sounds that are each enunciated by elongating a single phoneme, said phoneme database further storing a flat spectrum as an amplitude spectrum of the stochastic component of each of the voice fragment data comprising each of the elongated sounds, obtained by multiplying the amplitude spectrum thereof by an inverse of a typical spectrum within an interval of the elongated sound.

14. A singing voice synthesizing apparatus according to claim 13, wherein the amplitude spectrum of the stochastic component of each of the voice fragment data comprising each of the elongated sounds is obtained by multiplying an amplitude spectrum of the stochastic component calculated based on an amplitude spectrum of the deterministic component of the voice fragment data of the elongated sound, by the flat spectrum.

15. A singing voice synthesizing apparatus according to claim 14, wherein said phoneme database does not store amplitude spectra of stochastic components of voice fragment data comprising certain elongated sounds, and the flat spectrum stored as an amplitude spectrum of voice fragment data comprising at least one other elongated sound is used for synthesis of the certain sounds.

16. A singing voice synthesizing apparatus according to claim 14, wherein the amplitude spectrum of the stochastic component calculated based on the amplitude spectrum of the deterministic component has a gain thereof at 0 Hz controlled according to a parameter for controlling a degree of huskiness.

17. A singing voice synthesizing method comprising the steps of:

storing in a phoneme database a plurality of voice fragment data formed of voice fragments each being a single phoneme or a phoneme chain of at least two concatenated phonemes, each of said plurality of voice fragment data comprising data of a deterministic component and data of a stochastic component;

reading out from said phoneme database the voice fragment data corresponding to lyrics inputted by an input device;

adjusting time duration of the read-out voice fragment data so as to match a desired tempo and manner of singing;

adjusting the deterministic component and the stochastic component of the read-out voice fragment so as to match a desired pitch, said stochastic component being adjusted by varying a low frequency region of an amplitude spectrum of the stochastic component according to the desired pitch; and synthesizing a singing sound by sequentially concatenating the voice fragment data that have been adjusted in respect of the time duration and the deterministic component and the stochastic component thereof.

18. A singing voice synthesizing method according to claim 17, wherein, in said step of adjusting the deterministic and stochastic components, the stochastic component is adjusted by using an original amplitude spectrum for a high frequency region of the amplitude spectrum of the stochastic component.

19. A singing voice synthesizing method according to claim 17, wherein, in said step of adjusting the deterministic and stochastic components, the low frequency region of the amplitude spectrum is varied by compressing or expanding a frequency axis for the low frequency region of the amplitude spectrum of the stochastic component according to the desired pitch, with a general shape of the amplitude spectrum preserved.

20. A program for causing a computer to execute a singing voice synthesizing method comprising the steps of:

storing in a phoneme database a plurality of voice fragment data formed of voice fragments each being a single phoneme or a phoneme chain of at least two concatenated phonemes, each of said plurality of voice fragment data comprising data of a deterministic component and data of a stochastic component;

reading out from said phoneme database the voice fragment data corresponding to lyrics inputted by an input device;

adjusting time duration of the read-out voice fragment data so as to match a desired tempo and manner of singing;

adjusting the deterministic component and the stochastic component of the read-out voice fragment so as to match a desired pitch, said stochastic component being adjusted by varying a low frequency region of an amplitude spectrum of the stochastic component according to the desired pitch; and synthesizing a singing sound by sequentially concatenating the voice fragment data that have been adjusted in respect of the time duration and the deterministic component and the stochastic component thereof.

21. A program for causing a computer to execute a singing voice synthesizing method according to claim 20, wherein, in said step of adjusting the deterministic and stochastic components, the stochastic component is adjusted by using an original amplitude spectrum for a high frequency region of the amplitude spectrum of the stochastic component.

22. A program for causing a computer to execute a singing voice synthesizing method according to claim 20, wherein, in said step of adjusting the deterministic and stochastic components, the low frequency region of the amplitude spectrum is varied by compressing or expanding a frequency axis for the low frequency region of the amplitude spectrum of the stochastic component according to the desired pitch, with a general shape of the amplitude spectrum preserved.

23. A mechanically readable storage medium storing instructions for causing a machine to execute a singing voice synthesizing method comprising the steps of:

storing in a phoneme database a plurality of voice fragment data formed of voice fragments each being a single phoneme or a phoneme chain of at least two concatenated phonemes, each of said plurality of voice fragment data comprising data of a deterministic component and data of a stochastic component;

reading out from said phoneme database the voice fragment data corresponding to lyrics inputted by an input device;

adjusting time duration of the read-out voice fragment data so as to match a desired tempo and manner of singing;

adjusting the deterministic component and the stochastic component of the read-out voice fragment so as to match a desired pitch, said stochastic component being adjusted by varying a low frequency region of an amplitude spectrum of the stochastic component according to the desired pitch; and synthesizing a singing sound by sequentially concatenating the voice fragment data that have been adjusted in respect of the time duration and the deterministic component and the stochastic component thereof.

24. A mechanically readable storage medium storing instructions for causing a machine to execute a singing voice synthesizing method according to claim 23, wherein, in said step of adjusting the deterministic and stochastic components, the stochastic component is adjusted by using an original amplitude spectrum for a high frequency region of the amplitude spectrum of the stochastic component.

25. A mechanically readable storage medium storing instructions for causing a machine to execute a singing voice synthesizing method according to claim 23, wherein, in said step of adjusting the deterministic and stochastic components, the low frequency region of the amplitude spectrum is varied by compressing or expanding a frequency axis for the low frequency region of the amplitude spectrum of the stochastic component according to the desired pitch, with a general shape of the amplitude spectrum preserved.

* * * * *